US011247142B2

(12) United States Patent
Roth et al.

(10) Patent No.: US 11,247,142 B2
(45) **Date of Patent: *Feb. 15, 2022**

(54) VERSATILE ROBUST CONSTRUCTION TOY

(71) Applicant: Creative Toys LLC, Hollis, NH (US)

(72) Inventors: Richard F. Roth, Hollis, NH (US); Robert D. Klauber, Hollis, NH (US); Brian Klauber, Hollis, NH (US); Joseph J. George, Hollis, NH (US); Susan Klauber, Hollis, NH (US)

(73) Assignee: Creative Toys, LLC, Hollis, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/586,052

(22) Filed: May 3, 2017

(65) Prior Publication Data

US 2017/0239588 A1 Aug. 24, 2017

Related U.S. Application Data

(63) Continuation of application No. 13/639,746, filed as application No. PCT/US2011/035107 on May 4, 2011, now Pat. No. 9,669,324.

(Continued)

(51) Int. Cl.
*A63H 33/10* (2006.01)
*A63H 33/04* (2006.01)

(Continued)

(52) U.S. Cl.
CPC ..... *A63H 33/101* (2013.01); *A63H 5/00* (2013.01); *A63H 33/04* (2013.01); *A63H 33/042* (2013.01);

(Continued)

(58) Field of Classification Search
CPC ..... A63H 33/04; A63H 33/10; A63H 33/101; A63H 33/062; A63H 33/26; A63H 33/28
See application file for complete search history.

(56) References Cited

U.S. PATENT DOCUMENTS 2,674,827 A * 4/1954 Schaper ..... A63H 33/06 446/100
3,698,123 A 10/1972 Heidi (Continued)

FOREIGN PATENT DOCUMENTS

DE 1168305 4/1964
GB 2365795 2/2002

(Continued)

OTHER PUBLICATIONS

Polydron www.polydron.co.uk/index.htm.
Vicentelli www.geomagworld.com.

*Primary Examiner* — Eugene L Kim
*Assistant Examiner* — Alyssa M Hylinski
(74) *Attorney, Agent, or Firm* — Lambert Shorten & Connaughton; David J. Connaughton, Jr.; Justin P. Tinger

(57) ABSTRACT

A cost effective, structural building set, suitable as a toy, uses post connectors (10) comprised of a post (12) with attached disks (14), or similar devices that insert into cutouts (31) in geometric shaped component parts (30, 80, 180). More than one component part can be connected to the same post connector, and such component parts can rotate relative to the post axis. The connector design allows construction of stable structures of many sizes, shapes, and types, and readily facilitates hinging between different sections of such assembled structures.

37 Claims, 12 Drawing Sheets

Related U.S. Application Data

(60) Provisional application No. 61/334,230, filed on May 13, 2010.

(51) Int. Cl.

| | |
|---|---|
| ***A63H 33/06*** | (2006.01) |
| ***A63H 5/00*** | (2006.01) |
| ***A63H 33/26*** | (2006.01) |
| ***A63H 33/28*** | (2006.01) |
| ***A63H 33/08*** | (2006.01) |

(52) U.S. Cl.
CPC ..... *A63H 33/062* (2013.01); *A63H 33/08* (2013.01); *A63H 33/10* (2013.01); *A63H 33/26* (2013.01); *A63H 33/28* (2013.01)

(56) References Cited

U.S. PATENT DOCUMENTS

| | | | | | |
|---|---|---|---|---|---|
| 3,701,214 | A * | 10/1972 | Sakamoto | A63H 33/082 | 446/115 |
| 4,214,403 | A | 7/1980 | Knudsen | | |
| 4,253,268 | A | 3/1981 | Mayr | | |
| 4,606,732 | A | 8/1986 | Lyman | | |
| 4,792,319 | A | 12/1988 | Svagerko | | |
| 5,049,104 | A | 9/1991 | Olsen | | |
| 5,061,219 | A | 10/1991 | Glickman | | |
| 5,100,358 | A | 3/1992 | Volgger | | |
| 5,137,486 | A | 8/1992 | Glickman | | |
| 5,183,430 | A | 2/1993 | Swan | | |
| 5,199,919 | A | 4/1993 | Glickman | | |
| 5,209,693 | A | 5/1993 | Lyman | | |
| 5,322,467 | A * | 6/1994 | Barzani | A63H 33/06 | 446/125 |
| 5,372,450 | A * | 12/1994 | Blodgett | A63H 33/10 | 403/171 |
| 5,472,365 | A | 12/1995 | Engel | | |
| 5,545,070 | A * | 8/1996 | Liu | A63H 33/042 | 446/102 |
| 5,575,701 | A * | 11/1996 | Hantman | A63H 33/10 | 446/104 |
| 5,645,463 | A | 7/1997 | Olsen | | |
| 5,762,530 | A * | 6/1998 | Zheng | A63F 9/12 | 273/160 |
| 5,769,681 | A | 6/1998 | Greenwood | | |
| 6,089,941 | A * | 7/2000 | Glickman | A63H 33/101 | 446/108 |
| 6,186,855 | B1 | 2/2001 | Bauer | | |
| 6,566,992 | B1 | 5/2003 | Vicentelli | | |
| 6,969,294 | B2 | 11/2005 | Vicentelli | | |
| 7,371,147 | B2 | 5/2008 | Tusacciu | | |
| 7,588,476 | B2 | 9/2009 | Hammond | | |
| 9,669,324 | B2 * | 6/2017 | Roth | A63H 5/00 | |
| 2001/0041492 | A1 * | 11/2001 | Oren | A63H 33/00 | 446/85 |
| 2002/0086605 | A1 | 7/2002 | Kwan | | |
| 2002/0098774 | A1 * | 7/2002 | Huang | G09B 19/02 | 446/487 |
| 2005/0159076 | A1 * | 7/2005 | Kowalski | G11B 5/10 | 446/137 |
| 2006/0084357 | A1 * | 4/2006 | Rosen | A63H 33/107 | 446/91 |
| 2010/0041492 | A1 * | 2/2010 | Rice | A63B 53/12 | 473/289 |
| 2010/0130094 | A1 * | 5/2010 | Michalk | E04C 2/08 | 446/111 |

FOREIGN PATENT DOCUMENTS

| | | |
|---|---|---|
| GB | 2429934 | 3/2007 |
| WO | 97/21475 | 6/1997 |
| WO | 00/56415 | 9/2000 |
| WO | 03/031011 | 4/2003 |
| WO | 03/059481 | 7/2003 |
| WO | 2008-093028 | 8/2008 |
| WO | 2009/103967 | 8/2009 |

* cited by examiner

VERSATILE ROBUST CONSTRUCTION TOY

CROSS-REFERENCE TO RELATED APPLICATIONS

This application claims the benefit of U.S. provisional patent application 61/334,230, filed 13 May 2010, by the present inventors.

REFERENCE TO SEQUENCE LISTING, A TABLE, OR A COMPUTER PROGRAM LISTING COMPACT DISC APPENDIX BACKGROUND OF THE INVENTION n/a

BACKGROUND OF THE INVENTION

Field of the Invention

This invention relates to a construction toy comprising parts that allow a wide number of 2D and 3D geometric structures to be easily constructed, and has particular application to an improved means for joining subparts into various shapes, thereby providing enhanced strength, durability, safety, versatility and usability over prior art toys. The means for joining permits the creation of unique shapes, and thus promotes the expression of more unencumbered creativity than prior art.

Description of Related Art

Many prior art construction toys are composed of parts that are held together via magnetic means, such as those by Tusacciu (U.S. Pat. No. 7,371,147) and Vicentelli (http://www.geomagworld.com./, U.S. Pat. Nos. 6,566,992, 6,969,294). These are relatively awkward and cumbersome because the magnetic parts have to be kept away from each other, they tend to clump together, and they "jump" into unintended connections with other parts. Also, the balls and the cylindrical rods typically used in such toys roll away quite easily, and each is small enough to represent a potential choking hazard for young children. Additionally, the magnets may unintentionally attract other things during building, transporting, or storage. Further, the magnetic fields generated are potentially damaging to electronic items.

Such magnetically bound structures are not overly strong or durable, and cannot support relatively minor downward force or side loading without collapse or shape deformation. This makes the formation of closed compartments or boxes problematic, because such boxes are structurally weak and thus not capable of being utilized for much other than visual appeal. Additionally, although some hinging is possible, it is impractical and cumbersome, and this inhibits construction of model doors and gates, box lids/tops, or any other type of swinging device.

Further, due to the many magnets used, the parts are often expensive and heavy. Typically, rare earth magnets are employed to increase the holding force of the structures, and these stronger magnets have an additional price premium when compared to cheaper and lighter materials such as plastic or wood.

Still further, magnetic toys have scale limitations, as larger size requires stronger magnets to support a given structure. Larger versions of such toys would then become both expensive and potentially dangerous due to the strength of the magnet required to support the load. Additionally, the heavier weight would become excessive for children, and make the toy neither safe nor fun.

Other construction toys having mechanical connections, and not composed of magnets, include those of Hauser (German Pat 1,168,305), Heldt (U.S. Pat. No. 3,698,123), Knudsen (U.S. Pat. No. 4,214,403), Mayr (U.S. Pat. No. 4,253,268), Lyman (U.S. Pat. Nos. 4,606,732, 5,209,693), Svagerko (U.S. Pat. No. 4,792,319), Engel (U.S. Pat. No. 5,472,365), Tung (GB Pat Applic 2,365,795), Olsen (U.S. Pat. Nos. 5,049,104, 5,645,463), Glickman (U.S. Pat. Nos. 5,061,219, 5,137,486, 5,199,919), Volgger (U.S. Pat. No. 5,100,358), Swan (U.S. Pat. No. 5,183,430), Liu (U.S. Pat. No. 5,545,070), Bauer et al (U.S. Pat. No. 6,186,855), Hammond (U.S. Pat. No. 7,588,476), Greenwood et al (U.S. Pat. No. 5,769,681), and Polydron (http://www.polydron-.co.uk/index.htm).

Many of the non-magnetic construction toys employ hinges of various types, allowing component parts to swing relative to one another at different angles. With these, each side of the hinge is typically built into, and part of, a component part. When the component parts are juxtaposed, the two sides interlock, but allow a swinging motion. For most of these, such as those of Lyman, Mayr, Volgger, and Svagerko, the hinge is restricted in only allowing two component parts to connect together. It is not possible in those designs to attach three or more component parts together such that they all swing (rotate) about a common hinge axis. This restricts the user from extending a given structure in new directions to create a larger structure.

Other designs, such as those of Swan and Bauer et al, allow more than two component parts to be connected and rotate about a common axis. But such parts must each be unique, in having their hinge cutouts in different places along the hinge axis. That is, there cannot be a single common design for all the pieces that are hinged together, but a separate design for each. This severely increases production complications, as the variety of different hinge connections means many different parts must be made. It also reduces flexibility and makes the toy less intuitively obvious to children, because so many different interfaces are required to function together. Children would need to orient each different, but similar looking, part appropriately before connecting the joints together. Further, more complicated structures, which have parts hinged on more than one edge, are even more difficult to construct.

Engel's invention allows more than two component parts to be connected and rotate about a common axis, but lacks strength, particularly in a direction lateral to the axis. The connection mechanism between polygonal panels and cylindrical axles is inherently weak, and structures composed of them would readily fall apart when played with in any moderately vigorous way. Neither is their any means for rotational stabilization of the connection mechanism. Further, constructions made via his invention are not easy to assemble, but require dexterity to do so. And connecting more than one component part axially along an axle is not possible. Neither is it possible to affix wheels, balls or other objects at the ends of the connecting axle, and thus Engel's connecting axle cannot be used as a wheel axle for a model vehicle. Further, Engle does not have plates, blocks or other things attached to the components themselves. Tung's invention suffers the same deficiencies as Engel's and additionally, is unable to connect more than two components via the same connector.

Heldt's structural toy hinges the ends of two or more rods via rings or wheels, but there is no means to hinge component parts, such as panels or frames, along an edge.

Thus, at present, there appears to be no mechanically connected, strong, easy to assemble and disassemble construction toy that allows the edges of more than two identical component parts to be attached via a single hinging means with wide angle rotation of all parts on all edges.

Objects and Advantages of the Invention

Accordingly, several objects and advantages of the present invention are to provide superior stability, strength, and ease of assembly of 2D and 3D structures, typically in construction toys, over those of prior art. Other objects and advantages comprise greater flexibility in types of structures, wider range of allowable motion for mechanically connected structures, and superior opportunity for expression of creativity. A further object and advantage of the invention is a means to hinge component parts conveniently, flexibly, and easily into a wide range of stable structural configurations.

The present invention has scaling advantages, as well. It does not become impractical or cost prohibitive at large or small sizes, and has no reasonable dimensional limit. The parts of the invention can be made large enough to build life-size tables, chairs, carts, wagons, toy chests, storage bins, desks, children's forts, model houses/rooms for children, sleds, toboggans, benches, loveseats, and more, all of which would be structurally stable, durable, and easy to assemble.

These and other aspects of the invention discussed below provide significant benefits and advantages over prior art. Further objects and advantages of the invention will become apparent from a consideration of the ensuing description of it.

BRIEF SUMMARY OF THE INVENTION

The present invention provides significant advantages over prior art structural building systems by utilizing a unique means for connecting component parts. Said means comprises a connector (called a "post connector" herein), which, in the preferred embodiment, comprises a relatively elongated cylindrical shape, typically that of a rod, and one or more disks attached to, and effectively sharing a common axis with, the rod. The structural component parts are connected via the post connector and have one or more cutout(s), typically but not necessarily along an edge, into which the disk(s) may be inserted. With the disk(s) of a single post connector so inserted into one component part, the post connector and the component part thus joined may rotate relative to one another up to 360°. With the disk(s) of a single post connector inserted into two or more component parts, said parts are thus joined, and may, if desired, be swung about the post connector in hinge fashion virtually to any degree. Typically, the post connector is snapped into the component parts and results in a very stable composite structure, with a wide range of possible motions and arrangements.

In other embodiments, shapes other than rods and/or disks may be employed to compose the post connector. The rod, or other shape serving the same or similar purpose, may extend axially and such extension may contain one or more additional disks, or other shape(s) serving the same or similar purpose, such that more than one component part can be connected axially (in addition to multiple parts connected around the angular direction.)

The component parts can be any possible geometric shape, including, but not limited to, triangles, squares, rectangles, trapezoids, other polygons, pie shapes, circles, or parts thereof, tetrahedrons, boxes, other rectangular solids, prisms, spheres, ovoids, other 3D solids, and parts or sections of any of the foregoing. Said parts may have indented regions in, or near, the center portion or not. They may, or may not, have hollow openings in, or near, said center portion. With such indented (or hollowed open) regions, separate panels (or faceplates or facemounts) may be optionally inserted into the indented (or open) region(s) to provide added strength and diversity in the possible structures that can be built, enhance artistic appeal, and/or cultivate creativity in the builder.

The post connectors may have hollowed out sections, axially, radially, or in any direction. Such hollowed out sections can have string, wire, inserts, or similar devices strung through, or situated inside, them to provide additional strength, visual enhancement, or other advantage.

The invention, in its various embodiments, provides numerous advantages over prior art in a superior and wholly satisfactory manner.

DETAILED DESCRIPTION OF THE INVENTION

Figure 1:
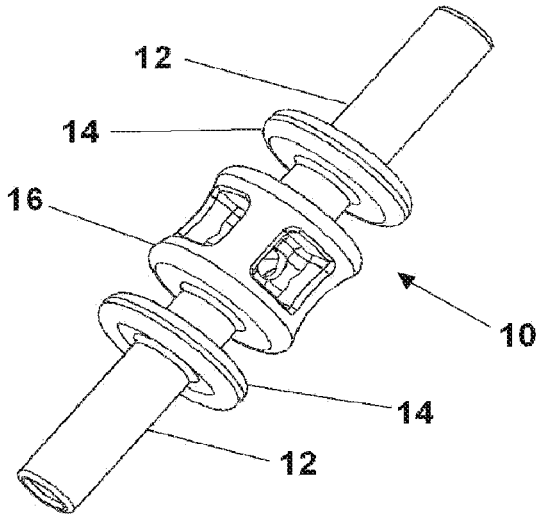
FIG. 1 depicts the post connector of the present invention in the preferred embodiment.
Figure 2:
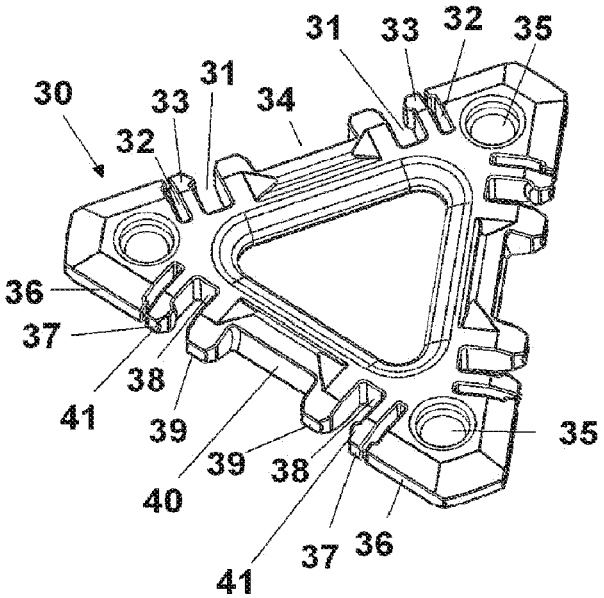
FIG. 2 illustrates a triangle shaped component part of the preferred embodiment.
Figure 3:
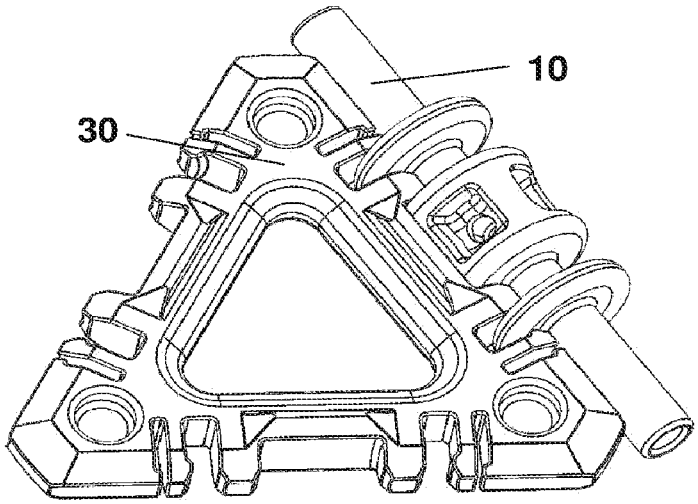
FIG. 3 shows the preferred embodiment post connector and a triangle component attached together.
Figure 4:
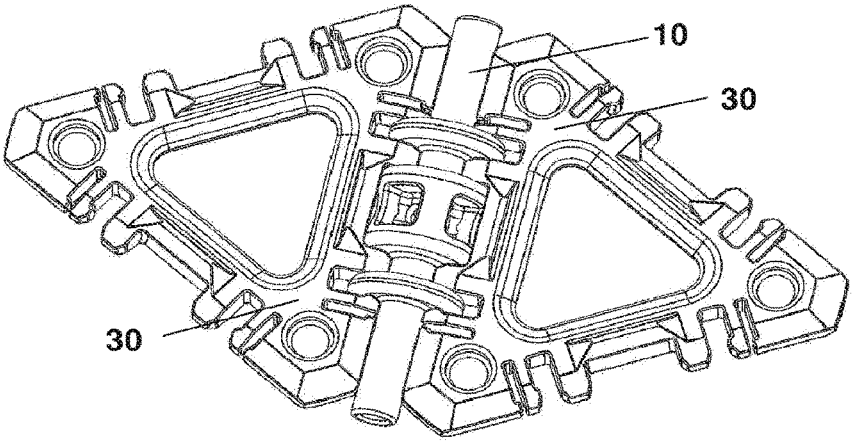
FIG. 4 depicts a post connector attached together with two triangle components.
Figure 5:
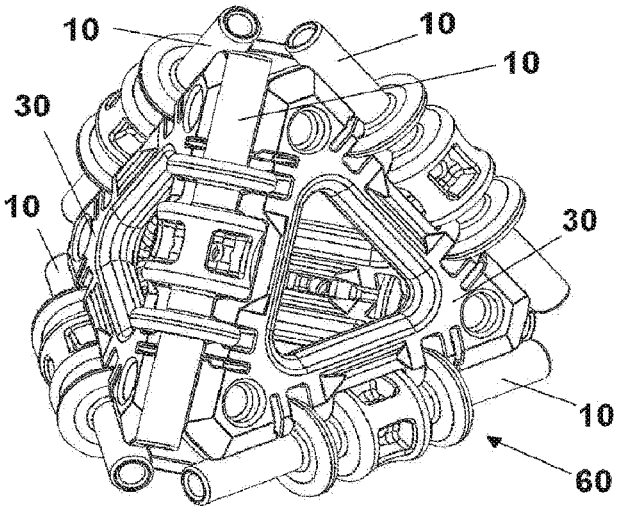
FIG. 5 shows a tetrahedron composed of four triangle component parts and six post connectors.

FIG. 1 shows a post connector 10 for the preferred embodiment of the invention. FIG. 2 illustrates one type of component part, the triangle component 30. FIG. 3 depicts a post connector 10 and a triangle component part 30 connected together. FIG. 4 shows two such triangle components 30 connected to a single post connector 10. FIG. 5 shows a tetrahedron assembly 60, a typical end result of assembling several (four in this case) triangle component parts 30 using (six in this case) post connectors 10.

The post connector 10 in the preferred embodiment of FIG. 1 comprises a post 12 of essentially rod-like shape with one or more disks 14 attached to, or integral with, the post 12, wherein the axes of the post 12 and the disk(s) 14 are essentially co-axial. In the preferred, and some other embodiments, the post connector may also comprise a cylindrical, or quasi-cylindrical, section, deemed herein, the connector guide 16. The axis of connector guide 16 can be essentially co-axial with the axis of the post 12. The term quasi-cylindrical, as used herein, refers to a shape, such as that shown for the connector guide 16 in FIG. 1, which has a non-purely cylindrical surface on what would otherwise be a cylinder. For example, a quasi-cylindrical shape can be considered to be what was originally a cylinder but which has had its surface indented, protruded, curved, and/or perforated.

In FIG. 1, the connector guide 16 is quasi-cylindrical, having a concave, indented surface, and said surface has perforations, including radially directed holes going completely through from one side to the other. Such holes can be filled with an overmould of rubber, plastic, metallic or other material, and said overmould can be solid or hollow. These perforations, and indentions, are not necessary for the functioning of the invention, but can add visual appeal, as well as desirable features that will be discussed herein.

The connector guide 16 is a means to guide the connection between the post connector and a component part. It can also be a means to stabilize, align, and/or strengthen the connection, though it is not necessary to the invention.

The disk(s) 14 and/or the connector guide 16 can be attached via any means to the post 12, or alternatively, one or more of them can be an integral part, along with post 12, of the post connector 10, such as could be accomplished by casting, injection molding, or other processes. Although the post 12 is shown extending outside of the disks 14, it is not necessary to the invention for it to do so. In any embodiment, post 12 only needs to support one or more disks 14 (or a means to connect the post to a component part), and that is what the invention comprises.

Component parts, such as triangle component 30 of FIG. 2, have cutouts, typically but not necessarily along their edges, into which portions of the post connector 10 can be inserted. Such cutouts comprise disk cutout(s) 31 and connector guide cutout 34. When portions of the post connector 10, such as disk(s) 14 and/or connector guide 16 are inserted into respective cutouts 31 and/or 34, the post connector 10 and the component part (triangle part 30 here) become connected. See FIG. 3. These cutouts can be large enough to permit rotation of a post connector 10 angularly about its long axis, relative to a component part (30 here). In fact, this is often desired, as it permits a hinging motion between the two parts, and as well, between sections of any further greater assemblies comprised of more post connectors and component parts. Alternatively, the cutouts can be small enough, or deliberately shaped, relative to the size of disk(s) 14 and/or connector guide 16, to effectively resist such angular motion and provide a non-hinge type of connection. Other kinds of restrictions, well known to those skilled in the art, can be used to provide a non-hinging connection, as well, and these are comprised by the invention.

Relief cutout(s) 32 can be used to enable easier snapping of a post connector 10 to a component part (30 in FIG. 2), and removal of same, while also providing a hard stop to prevent over-traveling the beam and potentially crack the latch member. Such relief cutouts are employed in this embodiment, but are not a necessary element of the invention. The connector guide cutout 34 is shown in FIG. 2 as straight and parallel to the triangle edge direction, but any suitable cutout is comprised by the invention. For best hinging effect, one or more of the cutout surfaces 36, 37, 38, 39, and 40 may be arc-like, to match the typically circular edges of post 12, disk(s) 14 and connector guide 16. However, any suitable geometry of such surface(s) is comprised by the invention, and none of those surfaces have to contact any portion of post connector 10.

Latch element 33, a cantilever employed in this embodiment, forms a latch with disk 14. One way it can do this is via the "bump" or "lip" 41, shown in FIG. 2, which snaps over the outer part of disk 14. Latch element 33, in this embodiment, is also arc-like along its inner facing side in FIG. 2 to match the profile of disk 14. This provides for more fluid hinging, though it is not necessary for the functioning of the invention. Latch element 33, although shown as a cantilever, can also be a raised dot, or bump, or in fact, anything that serves the same purpose as latch element 33 shown herein. Further, the latching element may be on the opposite side of disk cutout 31 (i.e., on the inner surface of cutout 38, the side closer to connector guide cutout 34). Still further, latching elements may be on both sides of the cutout.

Element 14 comprises a geometric form that includes non-disk, as well as disk shapes, and shall be deemed herein a "cutout insertable element". Thus, the cutout insertable element shall be considered represented by the number 14 in all figures, although in the preferred embodiment of FIGS. 1 to 3, it is disk-like. When the cutout insertable element is disk-like in shape, or an arc section of a full disk, we shall refer to it as a "disk". When such disk extends over a full 360°, we may sometimes refer to it as a "complete disk", or "360° disk". The cutout insertable element may be considerably thicker than the disk 14 shown in the figures, and may even be longer in the axial direction than its own diameter (or width in direction perpendicular to the axial.) See, for example, FIG. 32 for one possible alternative configuration of a cutout insertable element.

Holes 35 in the corners of triangle component part 30 are not essential to the functioning of the invention, but may aid with embellishments in certain embodiments of the invention to be described later. (See references to FIG. 20 herein. Also, holes 35 can be the same diameter as post 12 to enable mounting of post connectors 10, via their ends, into said holes.)

FIG. 4 shows two triangle parts 30 connected to a single post connector 10. For appropriate cutout to post connector portion tolerances, the two triangle parts can move angularly about the post connector, with respect to one another.

FIG. 5 shows a tetrahedron structure 60, one example of the type of structures that can be created from post connectors 10 and triangle parts 30. For a tetrahedron 60, four triangle parts 30 are used. For a stable tetrahedron (one for which the four triangle parts 30 will not easily move relative to one another), one can use between four and six post connectors 10.

Figure 6:
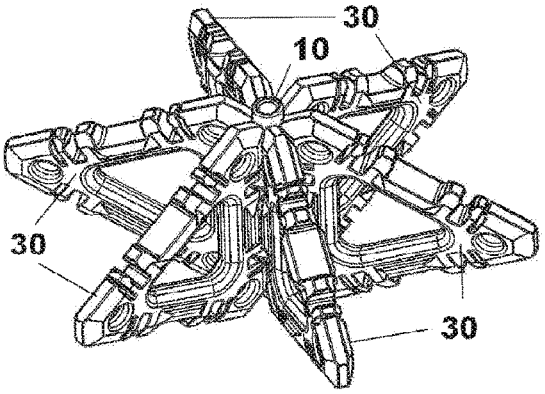
FIG. 6 shows a single post connector with more than two (six triangular parts in this case) component parts attached.
Figure 26:
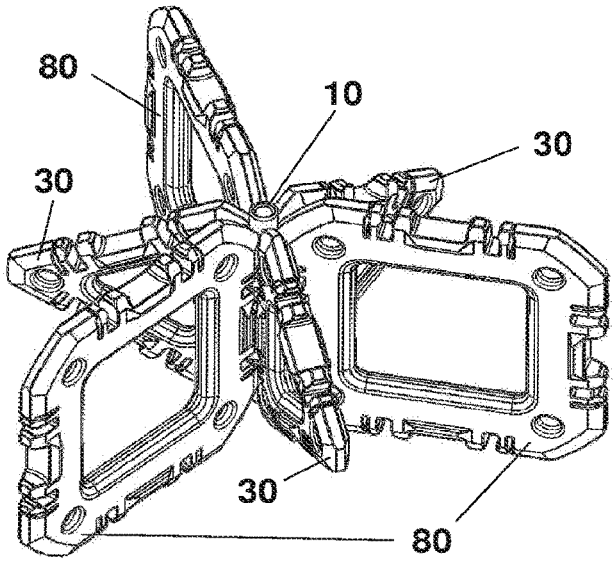
FIG. 26 demonstrates connection of different types of component parts (triangles and squares in the figure) via a single post connector.

FIG. 6 shows six triangular component parts 30 connected together via a single post connector 10. Said component parts can swing (hinge) about the post connector independently, or alternatively, they may be locked in place angularly. The invention permits, and comprises, any number of component parts connected via the same post connector. These need not be triangular, but can be any shape component part (see below.) FIG. 26 illustrates one example of such use, with three triangles and three squares all connected via the same post connector. A huge number of different combinations of component part types and post connector(s) can thus be connected with the invention, and all of these are comprised by the invention.

Figure 7:
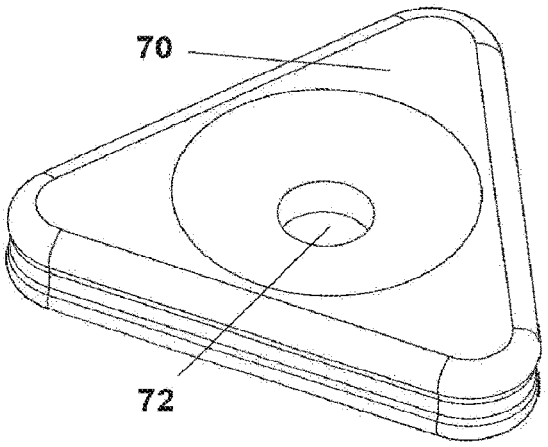
FIG. 7 shows a faceplate for a triangular component part with an optional hole.

FIG. 7 shows a faceplate 70 that can be inserted into a triangle component part 30 for the purpose of stiffening/strengthening the triangle component, for visual appeal, and/or for attaching post connector(s), other faceplate(s), pictures, decals, other component part(s), or any device that enhances the invention. The faceplate 70 displayed in FIG. 7 has an optional hole 72, which may, but does not necessarily have to, be in the center of the faceplate. In other configurations, there may be more than one hole, and any hole does not have to be circular, but can be any shape. The post portion of a post connector may be inserted into such hole, and such insertion can be snug enough to permit the post connector to be a part of an assembly of post connector(s) and component part(s). Other items, such as, but not limited to, a wheel axle, flower (artificial or real), rod, lollipop, flag, LED, and toy figure may be inserted into the hole, as well, or in lieu of the post connector.

Faceplates can also have cutouts or raised areas for the letters of the alphabet, numbers, words, etc., allowing children to study and/or snap together their ABC's, name, party invitation, age, etc. Any faceplate embellishments, such as those described herein or otherwise, can extend beyond the plane, and/or also beyond the edge(s), of any component part. Further, they can be quite thick and/or have hollow regions that may be filled with any number of items, such as, but not limited to, live fish, candy, glitter, lava lamp goo, etc. They can comprise, or allow attachment of, 3D items of many kinds. That is, faceplates can extend upward in the vertical direction of FIG. 7 to any reasonable height, and can extend sideways (sideways as seen in FIG. 7) to any reasonable extent. (See FIG. 43.) They can have knobs, plugs, or other means, threaded or otherwise, to attach any number of different items to them.

Both of the words "faceplate" and "facemount" may refer herein to devices that are either significantly extended in the vertical direction (away from a component face) or thin in the vertical direction (i.e., platelike.)

Figure 8:
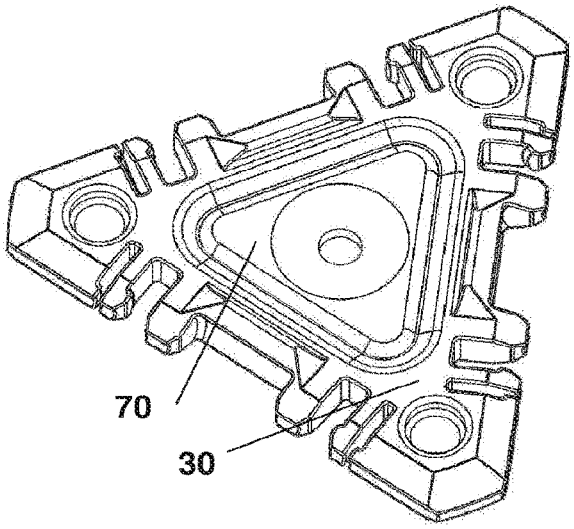
FIG. 8 shows a faceplate inserted into a triangular component part.

FIG. 8 depicts the faceplate 70 inserted into the triangle component 30. Although the discussion of FIGS. 7 and 8 focused on holding the faceplate by its sides onto the component part, the component part can attach to some other region of the component part. For example, the component part may be solid in the middle with a knob or other protrusion onto which a hole in the faceplate fits. Alternatively, the faceplate may a have a knob or other protrusion which fits into a hole in the component part. Any means to hold a faceplate snugly in the triangle, or any other shape, component part, including simple snaps well known to those skilled in the art, is comprised by the invention.

The invention comprises decals, paintings, laser markings, pictures, flags, mirrors, tattoos, hand written sheets, and similar items attached to the faceplates, though these are not necessary. The invention comprises any of the items discussed anywhere herein as being attachable to a faceplate, as being also attachable to a component part and/or a post connector.

Figure 9:
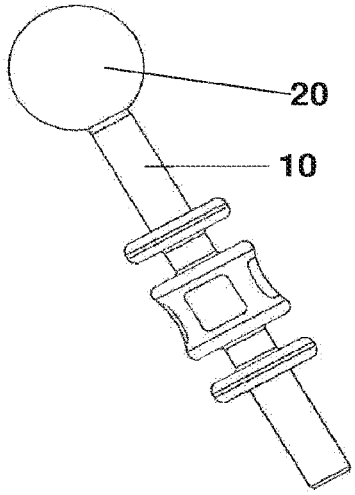
FIG. 9 illustrates a single sphere mounted on the end of a post connector.
Figure 10:
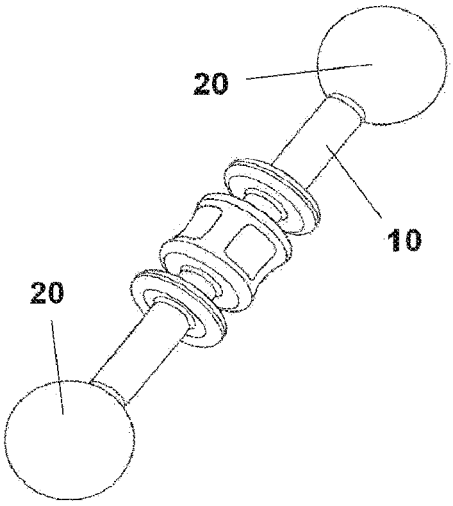
FIG. 10 depicts a post connector with spheres on each end.

FIG. 9 shows a post connector 10 with a single sphere 20 attached to one end. FIG. 10 shows a post connector with two such spheres, one on either end. Such spheres 20 may be rubber, plastic, wood, metal, or any suitable material. They may attach to the post connector 10 via any means, many of which are well known to those skilled in the art.

Alternatively, the spheres 20 could be manufactured as an integral part of the post connector 20 when the post connector is made, via casting, injection molding, or similar process.

Alternatively, any suitable object or device may be attached to, or inserted into, the end of a post connector 10. These include, but are not limited to, hooks, screw eyes, suction cups, threaded rods, magnets, whistles, springs, hinges, toys, toy figures, lollipops, wheel axles, flowers (artificial or real), flashlights, LEDs, and bubble wands.

Figure 11:
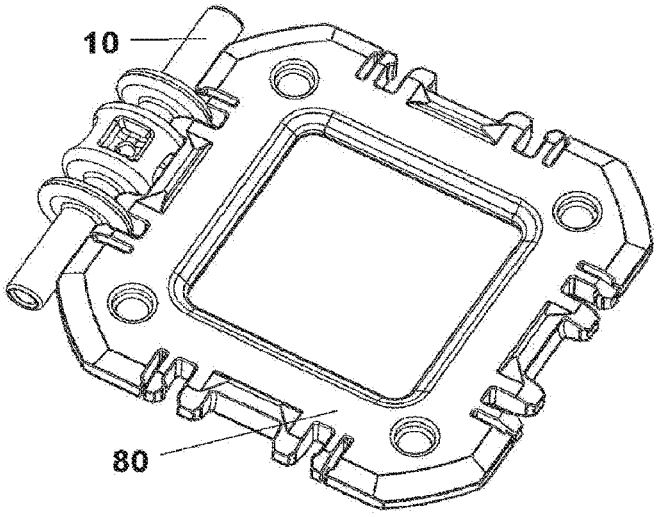
FIG. 11 displays a square component part with a single post connector attached.

FIG. 11 depicts a square component part 80 connected to a post connector 10. Square component 80 has cutouts like those shown for triangle component 30, to facilitate connection with post connector(s) 10.

The invention comprises square component 80 as well as all possible geometric shapes configured, as parts 30 and 80 are, to connect with a post connector 10. These other possible component part shapes include, but are not limited to, rectangles, parallelograms, pentagons, hexagons, all other polygons, circles, ovals, all other effectively 2D (thin in one dimension) shapes, rectangular solids, tetrahedrons, spheres, ovoids, all other 3D solids, and portions/sections of any of the foregoing.

With these various types of component parts, a user of the invention can create innumerable different types and sizes of structures. One can connect components of different types together. For example, the triangle component part 30 can be connected along an edge to a square component part 80 via the same post connector 10 as in FIG. 26. Boxes, homelike structures, pyramids, geometric forms of many diverse kinds, animal and bird models, dinosaurs (such as pterodactyls), and more are possible. The nature of the connections made between the post connectors 10 and component parts will provide significant stability and durability to these structural creations.

Given the swinging (i.e., hinge) capability of the connection between post connector 10 and component part, any component part in any structure can be configured to swing open or closed. This can provide a door, which can be opened and closed, for house-like structures, hinged lids for boxes/chests, model window shutters, book binders, and much more.

Figure 12:
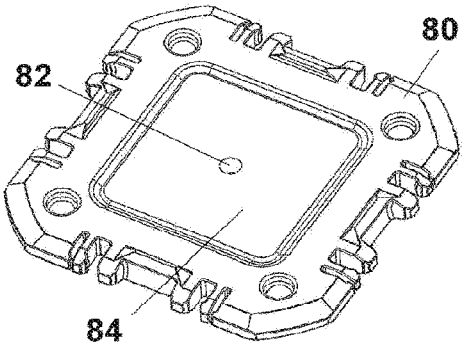
FIG. 12 illustrates a square component part with a faceplate and optional hole.

FIG. 12 illustrates a square faceplate 84 inserted into a square component part 80, similar to FIG. 8 for a triangle part 30. The present invention comprises faceplates for all possible component part shapes, as discussed above. Such faceplates may be used in all manners described above for the triangle faceplate 70.

Faceplates such as, but not limited to, 70 and 84 do not need to snap firmly into place and be held tightly by their associated component part (30 and 80 in the figures). Rather, they could be attached along their outer edge to the inner edge of a component part via a post connector 10 or any other form of removable connection. This would permit hinging or removal of the faceplates with respect to their associated component parts, and thereby provide for greater creative expression by children using the invention. Such faceplates could then become doors to house-like structures, lids for boxes, etc.

Figure 13:
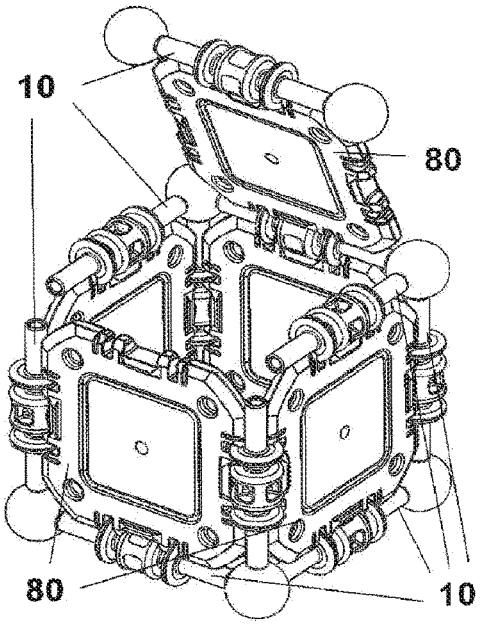
FIG. 13 shows a cubic rectangular solid made from square component parts and post connectors.

FIG. 13 shows square component parts 80 connected via post connectors 10 to form a box (cube type of rectangular solid with one face hinged open in FIG. 13). This box has a swinging top (lid) that opens and closes because it swings freely about a post connector, while the other parts of the box remain stationary. Of course, any face of the box, not just the top, may be used for swinging open and closed while the others remain fixed, and more than one face may swing open, as well.

Figure 14A:
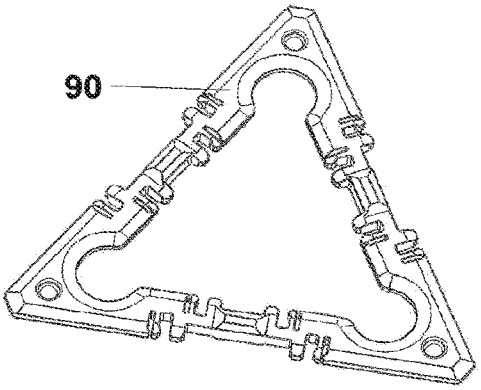
FIGS. 14*a* and *b* show another embodiment wherein component parts may be nested inside one another.
Figure 14B:
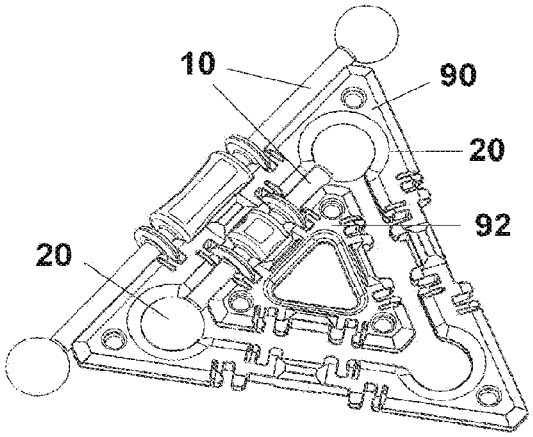

FIG. 14*a* shows a particular triangle component part 90 configured with cutouts on its inside edge(s) to permit nesting of a smaller triangle part inside of it. FIG. 14*b* shows such a nesting, with smaller triangle 92 fitting inside larger triangle component 90. In the embodiment of FIGS. 14*a* and *b*, the two triangles are held together via one or more inner post connectors 10, which are inserted into cutout(s) on (an) inner edge(s) of triangle 90 and (an) outer edge(s) of triangle 92. The post connector 10 used for this purpose, in this embodiment, is smaller than its sibling post connector 10 shown on the outside left edge of triangle 90. Due to the unique design of the post connector, the inner triangle 92 can swing, or hinge, about the inner post connector relative to the outer triangle 90. Such hinging may be desirable, but is not a necessary feature of the embodiment, as the connection can be made non-hinging as well, via any means known to those skilled in the art or otherwise shown herein.

Although FIGS. 14*a* and *b* depict an embodiment wherein the inner and outer triangles are connected via a post connector, in an alternative embodiment, the inner edge of triangle 90 is composed of disk insertable elements such as those on the post connector 10. (Similar to the outer edges of triangle 220 in FIG. 36.) The inner triangle 92 has appropriate cutouts on its outer edge(s) into which the disk insertable element(s) on the inner edge(s) of triangle 90 are inserted. Alternatively, the inner triangle 92 can have disk insertable element(s) on its outer edge(s), and the outer triangle 90 can have cutout(s) on its inner edge(s). Other inner-outer component part connection alternatives are comprised by the invention as well, including, but not limited to, that discussed later herein with reference to FIG. 41.

Nesting of any shape component part (for example, a square) inside any other shape component part is comprised by the invention. Further, nesting of more than two component parts is comprised by the invention, as well. For example, in FIG. 14*b*, inner triangle 92 can have yet another triangle (or other shape) component nested inside of it. There is no limit, other than practicality, for the number of component parts that may be nested inside of one another.

Nesting connections between component parts do not have to be done with post connectors, but may be done simply between components. That is, two parts can simply snap together, or attach to one another via any means described herein or known to those skilled in the art.

Nesting of component parts can provide structural support for resisting loads and/or stabilization for assemblies such as a bridge or tower.

Faceplates could, as well, be nested inside one another via the means shown above, any number of other connection means well know to those skilled in the art, or additional means shown elsewhere herein.

Figure 15:
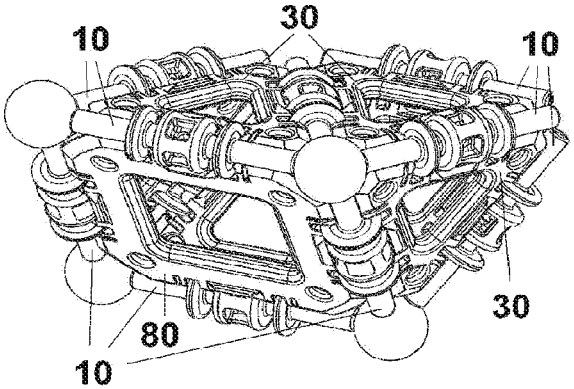
FIG. 15 displays a constructed assembly comprised of different types of component parts (triangle(s) and square(s) in this case).

An assembly constructed of different types of component parts is illustrated in FIG. 15. In the figure, triangle component parts 30 and square component parts 80 are connected together into a single assembly via the post connectors 10. Square parts can be connected to triangle parts via the same post connector. Similarly, any possible component part shape/type can be connected to the same post connector as any other possible component part shape/type.

Any possible assembly composed of a combination of different types and numbers of component parts is comprised by the invention. The number and variety of different assemblies are enormous, due to the unique and creative character of the present invention.

Figure 16:
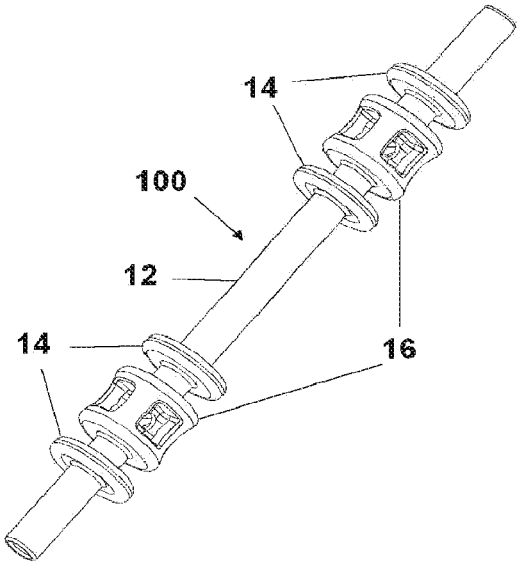
FIG. 16 illustrates an extended dual post connector capable of connecting two component parts along the axial direction.

FIG. 16 depicts a type of extended post connector 100, referred to herein as a dual post connector 100. Such a dual post connector is either i) two single post connectors 10 connected together end-to-end axially via any suitable means or ii) a single rod-like, or other shape, element with two post connector portions displaced from one another axially. That is, the dual post connector 100 is two single post connectors 10 joined together as essentially a single unit. The invention comprises other types of extended post connectors, such as a triple post connector made of three single post connectors 10, a quadruple post connector made of four single post connectors 10, etc. It also comprises any means for connecting more than one post connectors in any fashion, as well as having multiple single post connector components formed together as a single piece, as would be done via casting, injection molding, or similar processes.

Figure 17:
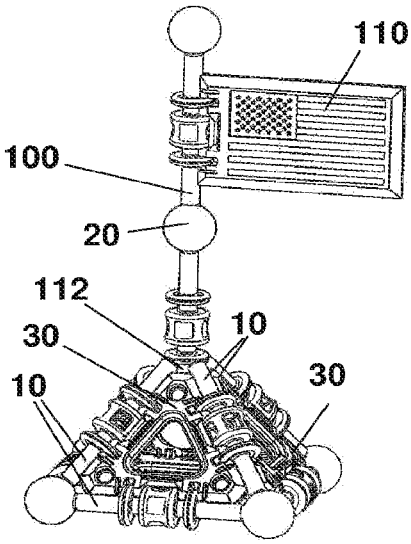
FIG. 17 shows one use, that of flying a flag from a structure, for the dual post connector.

FIG. 17 shows one use for a dual post connector 100, i.e., to hold a flag 110, as a post connected to a house-like, or tent-like, structure built from component parts such as 30 and other post connectors 10. In FIG. 17, post connector 100 is inserted into hole 112 formed in the top of the assembly shown, but it can be attached via any suitable means. In a rectangular model building of a home or fort, for example, two walls could be joined by a dual post connector with the top half of such connector extending upward beyond the top of the wall of the model building. The flag 110 could then be attached to the top half of that connector.

Figure 18:
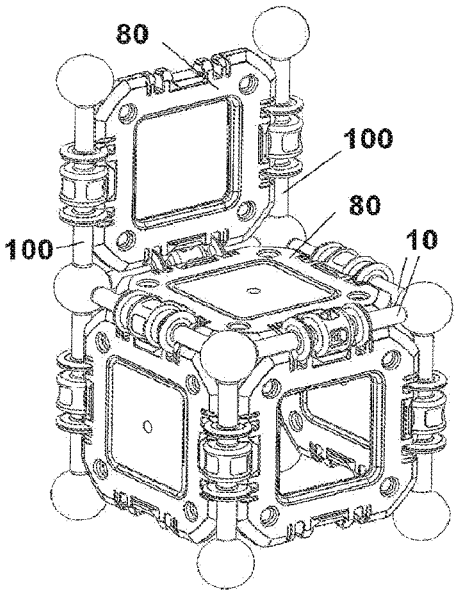
FIG. 18 depicts a chair constructed of component parts and using dual post connectors to support the back support portion of the chair.

Furniture can be made with the invention, as displayed in FIG. 18. That figure depicts a chair made of square component parts 80 and post connectors 10 and 100. The back support of the chair can be made of one, or more, square component parts 80 held firmly by dual post connectors 100 on either side. Said dual post connectors are held firm by being connected on one end to the chair base and on the other, to the back support. Optional spheres are shown in the middle of dual post connectors 100 in FIG. 18, but these are not necessary. Many types of furniture comprised by the invention can be constructed, such as, but not limited to, tables, beds, couches, stools, counters, waste baskets, mock kitchen sinks, mock televisions (and radios and stereos), and more.

Importantly, the lack of size limitation of the invention (large or small, it can be made strong and durable) means such assembled furniture can be doll house sized, child sized, or adult sized. Children could actually make their own tables and chairs, and use them daily in their activities.

Figure 19:
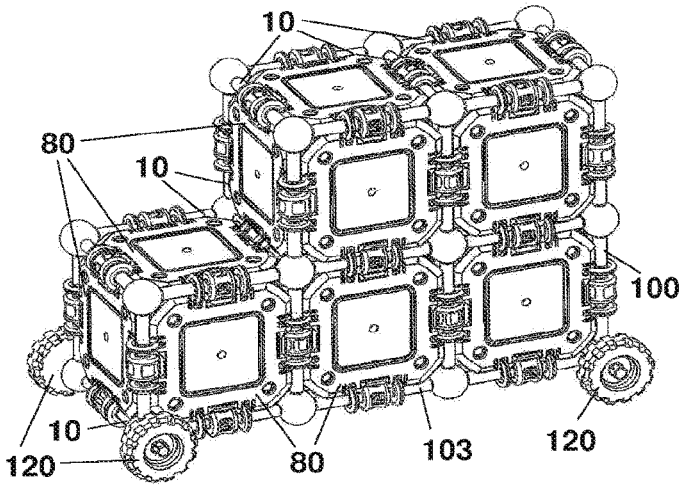
FIG. 19 shows a model vehicle constructed of component parts and post connectors with wheels attached to two of the lower post connectors.

Post connectors can also have wheels attached, permitting children to make moving vehicle structures. This is shown in FIG. 19, where the wheels 120 are attached at, or near, the ends of post connectors 10 in a car-like structure. The present invention comprises wheels 120 mounted anywhere on any post connector 10 for any purpose. Pulley systems, Ferris type wheels, and many other structures can be built.

Another use for extended, or multiple, post connectors is demonstrated in FIG. 19. The left rear support for the car of FIG. 19 can be a dual post connector 100, as shown in the figure (though it does not have to be) Similarly the bottom left edge (bottom front edge as viewed in FIG. 19) of the vehicle can be comprised of a single triple post connector 103 (though it doesn't have to be) FIG. 19 shows spheres on the ends of the post connectors 10, 100, 103, but these are not necessary. Similarly, it shows spheres inside the ends of the multiple post connectors 100 and 103. Said spheres are optional and may, or may not, be used according to the builder's desire.

Figure 20:
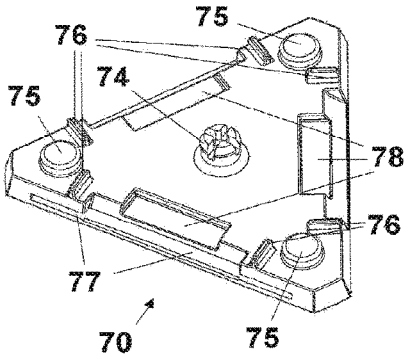
FIG. 20 depicts details of one configuration for a component part faceplate

A detailed illustration of one embodiment of a faceplate 70 for a triangular component is depicted in FIG. 20. In that embodiment, protuberances 75 on the three corners of faceplate 70 insert into holes 35 in a triangular part 30 as shown in FIG. 2, and hold the faceplate 70 to triangle 30. Cutouts 78 in faceplate 70 make space to accommodate connector guides 16 of post connectors along each edge of the faceplate. Optional protuberances 76 fit into relief cutouts 36 on the triangle. These can create a lockable faceplate by inhibiting deflection of latching elements (see, for example latching element 33 of FIG. 2), and thus prevent the post connector from releasing.

With the embodiment of FIG. 20, or with other embodiments, the faceplate (element 70 in FIG. 20) can be transparent. One can place pictures, stencils, hand or printer written sheets, or similar things on the surface of a faceplate or internal to the faceplate in optional slot 77. The faceplate can then be attached to a component part via knob (also called a protuberance or post) 74, or any appropriate latching means commonly known to one versed in the arts, to secure the faceplate 70 to a component part. Once the faceplate 70 is secured any images or stencils placed in slot 77 will not fall out, because the post connector (10 of FIG. 1, for example), when attached, will prevent it from doing so. In this way, the image can be viewed though the faceplate, yet be both removable and protected. As another alternative, images, stencils, hand or printer written sheets, and any other such things could be adhered directly to the faceplate.

The invention comprises any attachment means for connecting a faceplate with a component part, and is not restricted to the particular attachment means, protuberances, knobs, post, cutouts, etc. shown in the embodiment of FIG. 20

Faceplates may also be composed of more than one piece, or more than one faceplate may be attached to a component part. For example, two faceplate pieces can fasten together, one on each side of the component part.

Further, faceplates may have their own faceplate-to-faceplate connectors, whereby faceplates, either already attached to component parts or not, can be attached to one another.

All of the discussion above for FIG. 20 also relates, and applies, equally as well to any other component part shape, such as squares, rectangles, other polygons, and more, and their associated faceplates. Further, while any of the elements shown in FIG. 20, and/or discussed herein with respect to FIG. 20, may help in the functioning of the invention, none are necessary for it. Different embodiments of the invention may use any number, or none, of them.

Figure 21:
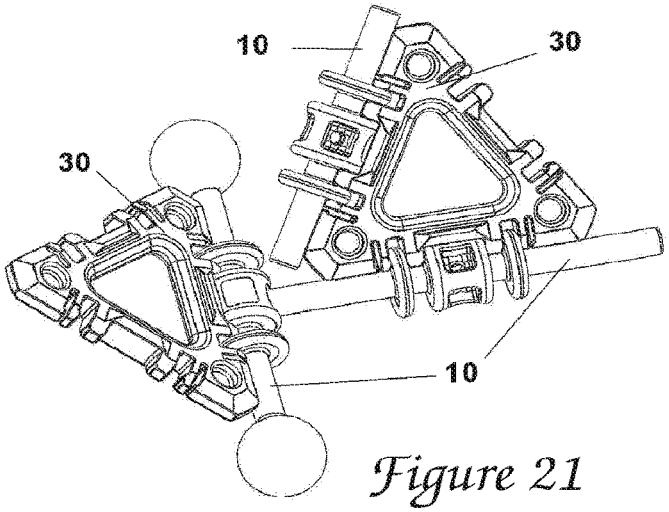
FIG. 21 shows a post connector inserted into a hole in another post connector with component parts connected to both of these post connectors.

Post connectors such as, but not limited to, 10, 100, and 103 can have hole(s) in their sides into which the end(s) of other post connector(s) may be inserted. One such configuration is shown in FIG. 21, where a triangle component is connected to each of the two post connectors 10 that are connected hole-to-end. Other devices and objects may be inserted into the side hole of a post connector, such as, but not limited to, all of the objects, devices, and toys listed above that may be inserted into the end of a post connector. Such holes(s) further expand the range of possible things that can be created with the invention.

Figure 22:
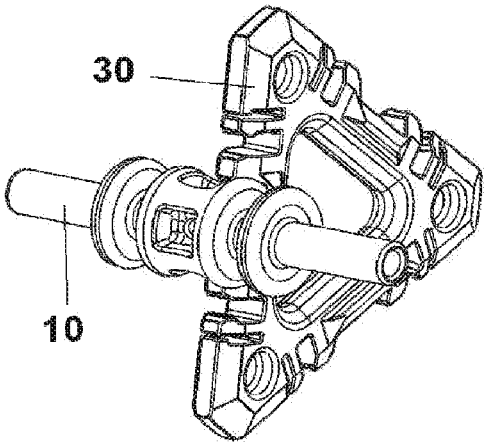
FIG. 22 illustrates a post connector connected to a component part wherein the post connector axis is effectively perpendicular to the component part edge.

A post connector does not have to be connected such that its axis is aligned with the edge of a component part, but may be aligned with its axis perpendicular to such edge as, for one example, in FIG. 22. Any possible alignment of the post connector axis with respect to a component edge is comprised by the invention. Such post connector can be integral with the component part such as would be accomplished via casting, injection molding, or similar process. Alternatively, it could be connected to the component part via any means shown herein or known to those skilled in the art. It could snap or clip into place, for example.

Figure 23:
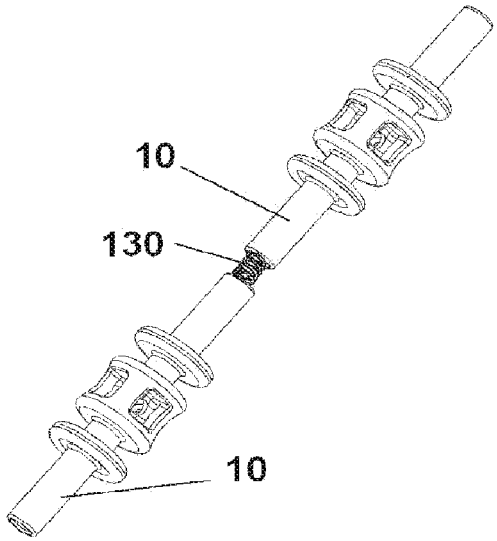
FIG. 23 shows one way, via a spring, to connect two post connectors end-to-end.

Two post connectors 10 (or 100 or 103 or otherwise) can have their ends connected either rigidly, via means well known to those skilled in the art, or via non-rigid connections such as the spring 130 shown in FIG. 23. In lieu of the spring 130, a hinge, piece of rubber, or other flexible device or material may be used. For any such flexible connection the post connectors may thus be bent out of axial alignment with one another. Any such connection—flexible, rigid, or malleable—can provide non-axial alignment to post connectors. One example of such a connection would be a plug, one end of which inserts into the open end of one post connector; the other end of which inserts into the open end of a second post connector. All such types of end-to-end post connector connection further expand the range of possible assemblies, and the functioning of such assemblies, provided by the invention.

Figure 24:
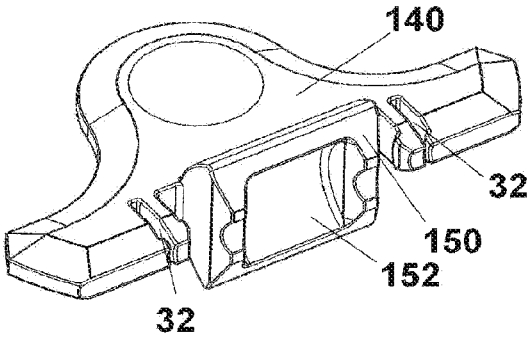
FIG. 24 depicts a component part that prevents two component parts from moving angularly relative to one another.
Figure 25:
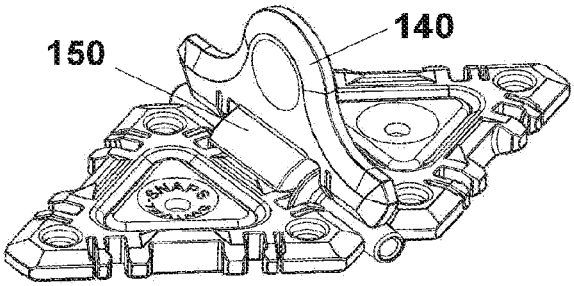
FIG. 25 shows a component limiting the angular motion of two triangle component parts.

An angle limiting component part 140 is illustrated in FIG. 24. Such a component part, when connected to a post connector as shown in FIG. 25, prohibits angular motion of component parts, such as the triangles in FIG. 25. The motion prevention means 150 prevents either triangle component part from moving upwards in FIG. 25. In this example, the motion prevention means 150 fits over, and snaps onto, the connector guide, though that particular mode of functioning is not necessary for the invention. Any such motion prevention means incorporated into an angle limiting component is comprised by the invention.

Figure 27:
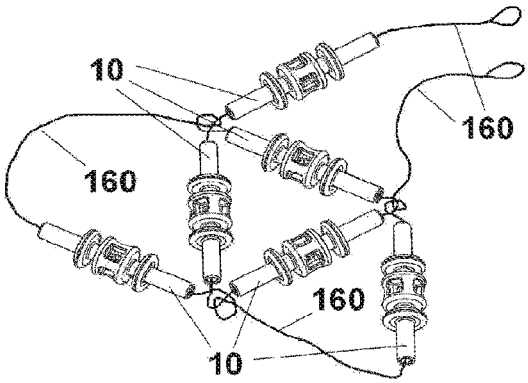
FIG. 27 displays cord passed through hollow post connectors and linking the connectors.
Figure 28:
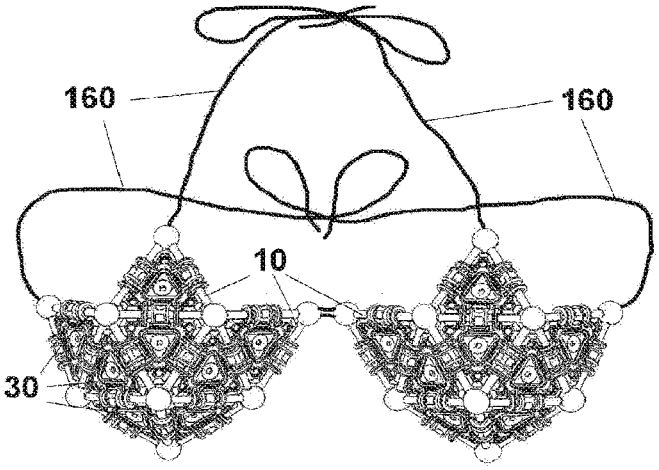
FIG. 28 shows a bra/woman's top constructed of cord, post connectors, and component parts (triangles in the figure.)
Figure 29:
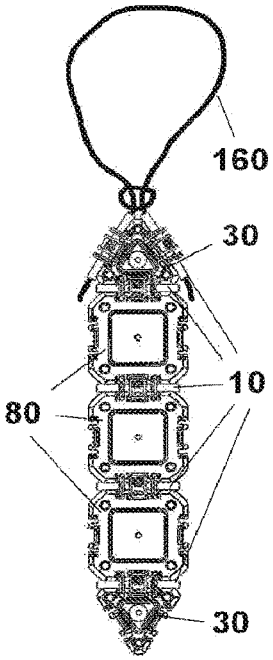
FIG. 29 depicts a tie constructed from cord, post connectors, and component parts (triangles and squares in the figure.)

Cord, string, wire or similar thing(s) 160 may be strung through component parts and/or post connectors as shown in FIGS. 27, 28, and 29, to hold component parts and/or post connectors together and form articles of clothing or many other things. In FIG. 28, cords 160 are used along with triangle components 30 to form a woman's bathing suit top or bra. In FIG. 29 cording is used to connect post connectors 10, squares 80, and triangles 30 to form a tie.

Figure 30:
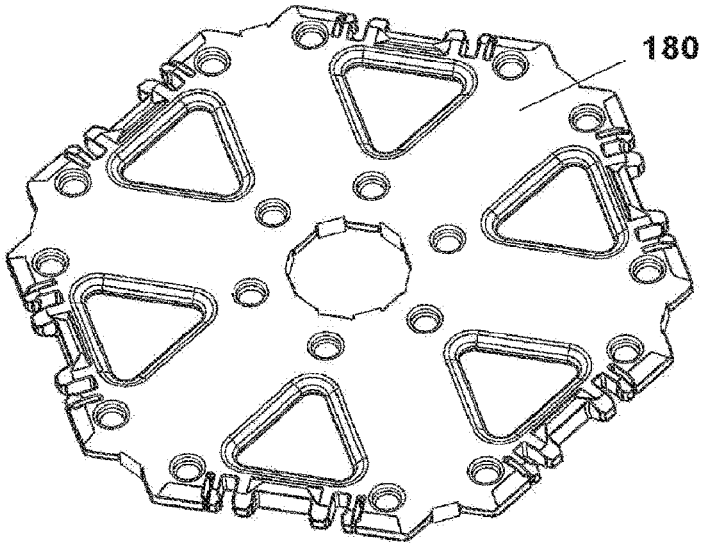
FIG. 30 shows a six sided component (equilateral hexagon in the figure.)

A regular hexagon component part 180 is depicted in FIG. 30. Non-regular hexagons (with different lengths or angles of its side), regular and non-regular pentagons, and any other polygon (equilateral [i.e., regular] or not) are also comprised by the invention.

Figure 31:
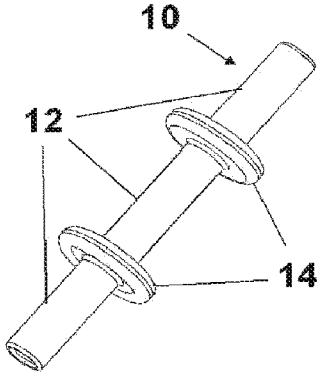
FIG. 31 illustrates a post connector with disks and without a connector guide.

FIG. 31 illustrates another embodiment of post connector 10 in which two disk type cutout insertable elements 14 are attached to, or integral with, a post 12, and for which no connector guide is used. Cutouts on component parts used with such a post connector embodiment would match the cutout insertable elements 14, and may, or may not, have cutout(s) for connector guide(s). Although FIG. 31 shows two disks 14, the invention comprises use of a single disk (or a single cutout insertable element.) Thus, the invention includes any number of disks 14 (or cutout insertable elements.)

Figure 32:
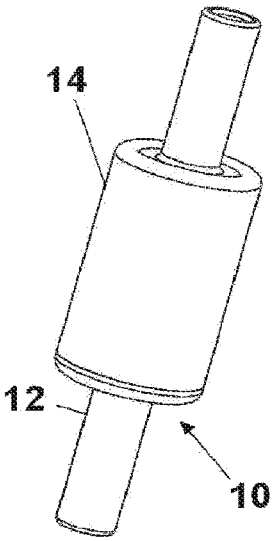
FIG. 32 displays a post connector with a cylindrical post connector connecting element instead of a thin disk.
Figure 33:
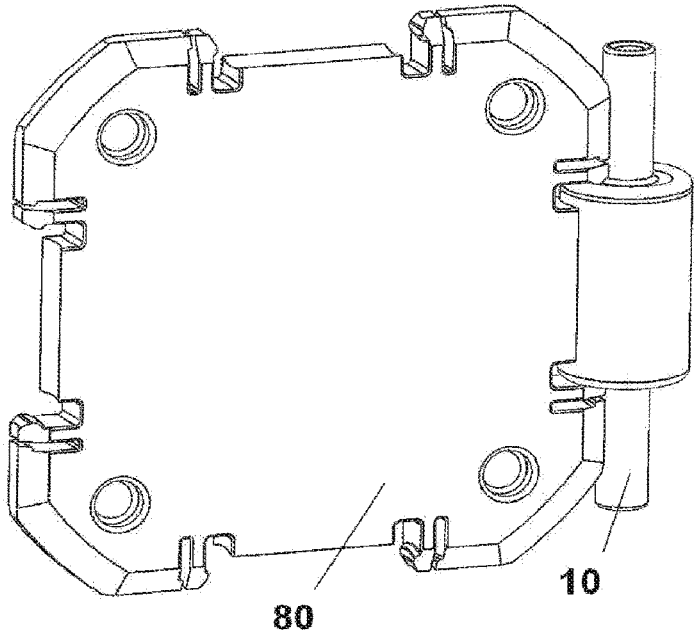
FIG. 33 depicts the post connector of the prior figure connected to a square component part.

FIG. 32 shows still another embodiment of post connector 10 in which a cutout insertable element 14 of cylindrical shape is attached to, or integral with, a post 12. FIG. 33 illustrates the connection of such a post connector embodiment 10 with a square component 80. Cutouts on the square need only match the cutout insertable element 14, but may, or may not, also have cutouts for cutout insertable elements of disk or other shape and/or connector guide(s). The extensions of rod 10 shown above and below cutout insertable element 14 in FIG. 32 are not necessary for the functioning of the invention. That is, the post connector may comprise a cutout insertable element, similar in function to, though not necessarily the same geometry as, the cutout insertable element 14 of FIGS. 32 and 33. Thus, the invention also comprises a post connector comprising a single cutout insertable element. (See FIG. 42.)

Figure 34:
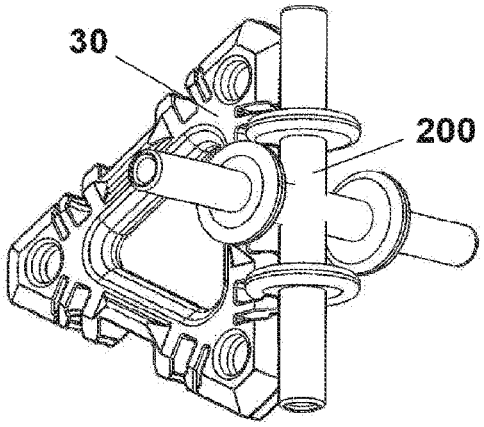
FIG. 34 shows a cross post connector with two posts perpendicular, and fixed, to one another.

Another embodiment of the invention is illustrated in FIG. 34, which has two posts integral with one another and aligned at right angles, deemed herein a dual cross connector 200. The angle of the crossing of the two posts does not have to be a right angle, but can be any suitable angle. The two posts do not have to be integral to one another, as could be accomplished by casting or molding, but can be joined in any other suitable fashion known to those skilled in the art. In some configurations, the two posts in FIG. 34 can swivel with respect to one another such that they can form any reasonable angle relative to one another. One way such a swivel can be configured via a rod fixed to one single post connector and at right angles to the axis of that post connector. The second post connector can have a hole in it transverse to its own axis that fits over the rod of the first connector. Many other means well known to those skilled in the art can be employed to configure the two post connectors to swivel with respect to one another, and all of these are comprised by the invention. Also, the posts are shown as rod shaped, but any suitable shape is comprised, in any embodiment, by the word "post".

Figure 35:
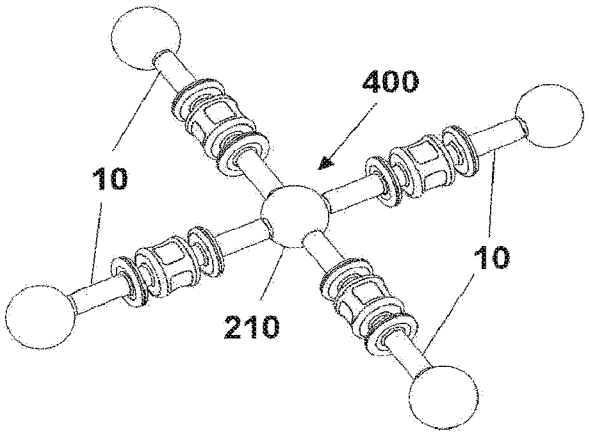
FIG. 35 shows a multiple post connector structure with single post connector parts attached at their ends and extending radially away from their center of attachment.

Post connectors 10 fixed to one another at, or near, their ends, as via connection 210 in FIG. 35, are also comprised by the invention. Connection 210 is typically a rigid connection, but not necessarily so. It may be a flexible connection, allowing any post connector 10 freedom of motion with respect to any other post connector 10. Any number of post connectors 10, or extended post connectors, can be connected in such fashion. For example, three post connectors 10 can be connected similar to the four of FIG. 35. Such post connectors extend radially outward in two or three dimensions from the end connection (the connection point of their ends). This configuration is called an end joined connector assembly 400, and though shown in FIG. 35 as having four post connectors 10, it may comprise any number of post connectors. An end joint connector assembly such as 400 may be a single integrated unit, as may be achieved by casting or molding, or it may comprise separate post connectors 10 attached together.

In any such assembly, the angles between post connectors 10 do not have to all be equal, as shown in FIG. 35. Each single post connector can have any angle relative to any other post connector. Neither do all post connectors have to lie in the same plane as shown in FIG. 35. For example, they could be aligned to form a frame for a teepee. They can also be configured to be free, or rotate, about a central post connector's axis.

End joined connector assemblies further expand the number of possible structures that can be created with the present invention.

Figure 36:
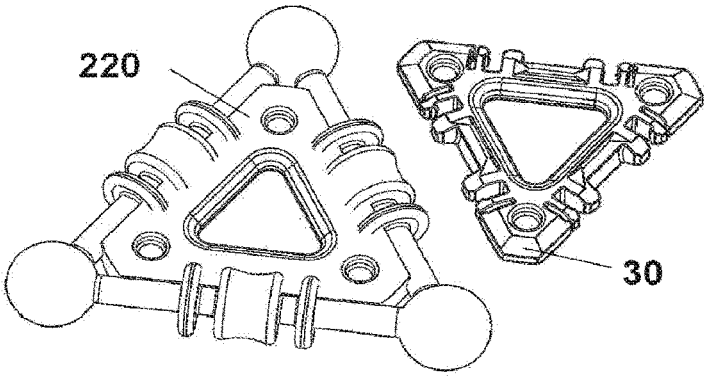
FIG. 36 displays disks and connector guides incorporated into the edges of a component part which are inserted into cutout(s) on another component part.

Another embodiment of the invention comprises one or more cutout insertable element(s), as shown in FIG. 36, attached to, or integral with, a component part (triangle 220 in FIG. 36.) Such cutout insertable element(s) may then be inserted into a component part having cutout(s) (triangle 30 in FIG. 36) to build structures. Connector guide(s) on the component part may, or may not, be used, in addition to, or in place of cutout insertable element(s). In FIG. 36 a connector guide is used on each edge.

Figure 37:
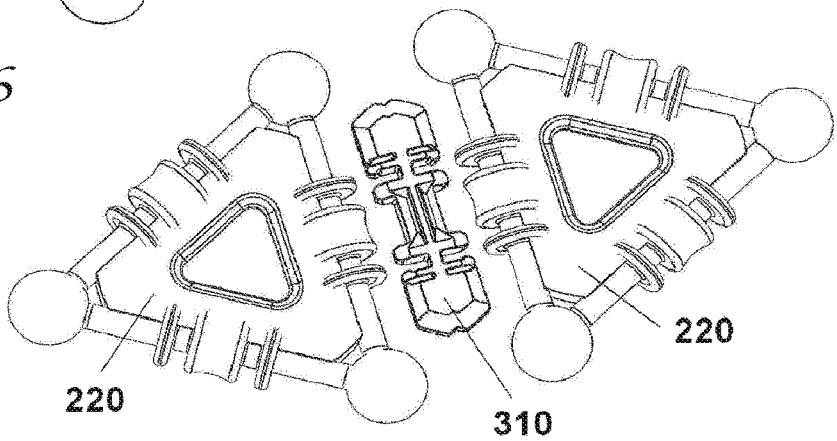
FIG. 37 illustrates disks and connector guides incorporated into the edges of a component part which is inserted into cutout(s) on a cutout (or female) post connector.

A similar, yet different, embodiment of the invention is demonstrated in FIG. 37. In that figure, cutout insertable elements 14 (disk shape embodiment in FIG. 37) are attached to, or integral with, a component part (triangle 220 in FIG. 37.) The cutout(s) to match the cutout insertable element(s) 14 are in the cutout post connector 310. Thus component parts and cutout post connectors can be connected in this embodiment by inserting the cutout insertable element(s) 14 into the cutout(s) in the cutout post connector 310. Component parts can then rotate angularly in similar fashion as in other embodiments.

The term "post connector" comprises both male post connectors 10 (and 103, 110) as well as female post connectors such as the cutout post connector 310. The invention comprises use of cutout post connector(s) 310 (female post connectors) in any embodiment shown anywhere herein in place of male post connector(s) 10. It also comprises use of cutout insertable elements 14 attached to, or integral with, a component part in place of cutouts in any embodiment, as well.

Cutout (female) post connector 310 may function best by being flat in two dimensions and thin in a third, as shown in FIG. 37, but it is not limited to such a configuration. A cutout, or female, post connector comprises any means to connect component parts comprising cutouts on such female post connector.

Figure 38:
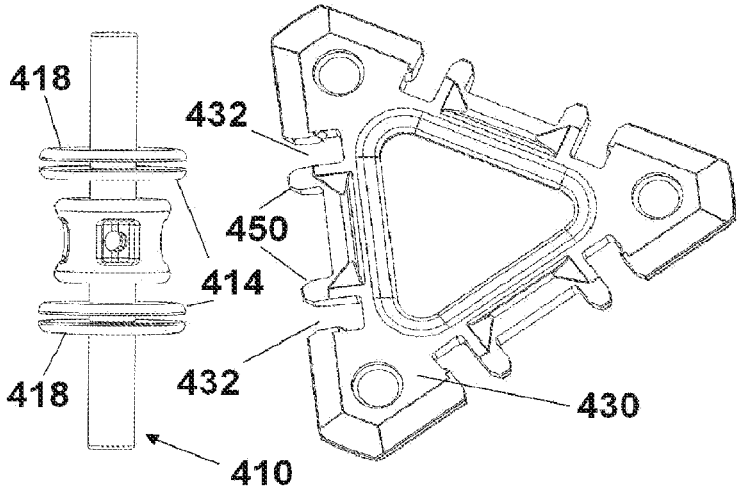
FIG. 38 depicts an alternative latching means for post connectors and component parts.

In the embodiment shown in FIG. 2, relief cutouts 32 enable cutout insertable elements 14 to be snapped into cutouts 31 because such relief cutouts provide flexibility to the cantilever extension between relief cutout 32 and cutouts 31. The cantilever extension can bend as the cutout insertable elements 14 are inserted into the disk cutouts 31, but then hold the cutout insertable elements 14 in place thereafter. In the embodiment of FIG. 38, the roles, in terms of flexibility, are reversed. Two disks (cutout insertable elements, more generically) 414 and 418 are used in place of each single cutout insertable element 14, and no relief cutout 32 is needed. The flexibility to enable snapping together of the post connector 410 and component part 430 is now provided by the two disks 414 and 418. They move relative to one another (closer typically) as the post connector 410 is snapped into the cutout 432 of component part 430. Elements 414 and 418 functioning together comprise a single cutout insertable element 14. Note, nonetheless, that element 414 is not a necessary part of the invention, though it can aid in protecting the latching function of cutout 432. In other embodiments, cantilever 450 can have a latching bump/lip in addition to, or in place of, the bump/lip on the opposite side of cutout 432, and this, in conjunction with element 414 can provide other latching means.

The term post connector comprises both element 410, and element 10, though we may at times use the term "flexible connection post connector" to describe element 410.

Figure 39:
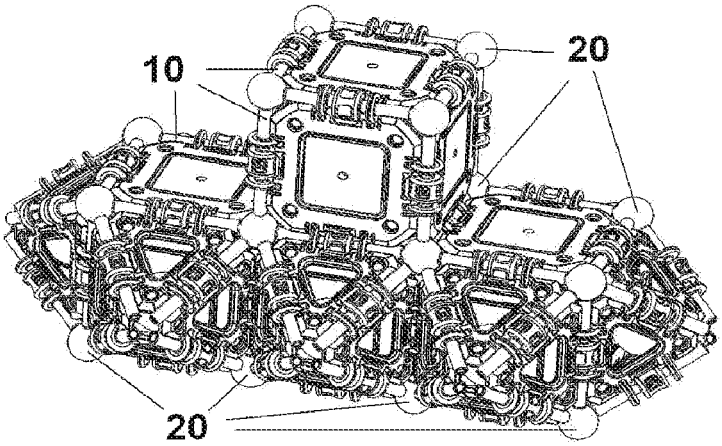
FIG. 39 shows a model boat that floats.

The range of construction possibilities provided by the invention is illustrated by FIG. 39, which shows a model boat that floats constructed of component parts and post connectors. The spheres 20 attached to the ends of post connectors 10 can be filled with air and made airtight (or made of material lighter than water) and thus enable the model to float in bathtubs, swimming pools, lakes or other bodies of water. Alternatively, or in addition, post connectors and/or component parts can be made less dense than water and thus aid, or provide, flotation ability to models. As yet another alternative, lighter than water material, such as foam or air filled balls, can be placed inside a model boat and enable, or help, it to float.

Further construction assemblies comprised by the invention include sleds and toboggans, which could use an attachable sled runner accessory. These could be made large enough for actual use in snow by children. These could be made, for example, with two sections for two children, and enlarged to three sections for three children, simply by building and attaching an additional section to the original two. Similarly, a bench or loveseat can be assembled simply by latching together two or more chair assemblies. Thus, the invention allows assemblies to be constructed which may be readily, and dynamically, changed for new or additional purposes.

A component part and/or a post connector (including a cutout post connector) may incorporate, or be, a musical instrument. For example, a whistle, bell, tuning fork, or guitar type string(s) could be part of a triangular, square, or other component part. They could be attached, or the part itself could be an instrument. One way this may be done is by making a component part hollow and having a opening into which a person could blow air and cause a sound to be emitted from the component part. Other holes could exist in the part allowing the user to cover such holes or not, thereby changing the note(s) played by the part/instrument. In addition, a component part, or a faceplate for a component part, could be fashioned like a drum, such that tapping it produces a drum-like sound.

Similarly, a post connector could be a whistle or flute. It could be hollow, or partially hollow, with one or both ends open and optionally, a mouthpiece on one end facilitating the playing of musical notes via blowing air through the mouthpiece or open end. Such post connector could have one or more holes or slits in it allowing different notes to be played depending on whether the user covered said holes and/or slits. The invention also comprises one or more slits in a post connector designed to fit up against a component part, such that by moving the component part angularly, the size of the opening allowing air to escape is changed, thereby changing the pitch of the note(s) played.

By appropriate alignment of component parts via post connector connections, parabolic or similar surfaces can be formed. By mounting mirrors or other reflective material on the component parts (and/or post connectors and/or faceplates), one could build a solar cooker from the invention, and such solar cooker is comprised by the invention.

Faceplates for any component part, such as faceplate 70 for a triangle component part, can have one or more holes for mounting wheels, or wheel axles, as well. Any faceplate could also have a knob, or similar structure, to permit mounting of one or more wheels.

The post connectors 10 (and 100, 103, 310, and 410) can be hollow axially, to save weight or to permit strings, wires or similar things to pass through them. As noted previously, the post connectors can also have holes passing through them radially. Such holes and hollows allow creative use of cords, strings, wires, or the like in many ways, can add strength to any structure, and may provide added visual appeal. Holes through, or simply in the ends of, post connectors can be threaded, enabling knobs, spheres, end connectors to other post connectors, or any number of other items to be threaded into such end holes.

Although post connectors 10, 100, 103, 310, and 410 have been shown herein in prior figures to be rod-like, they are not limited to any particular shape. They could, for example, have hexagonal, square, or any other cross section, rather than circular. They could be something other than straight in the axial direction. The invention comprises any shape post connector and associated component part which permits two or more component parts to be connected and move (swing or hinge) relative to one another in the angular direction of the post connector (around the axis of the post connector.) This may comprise disk, cylindrical, partial disk section, partial cylindrical section, quasi-cylindrical, quasi-cylindrical section, ring, or other shape portions of the post connector that may be inserted into cutouts in a component part.

The cutouts may be of any suitable shape and/or type that accommodate such insertion and motion. The post connector may be of any suitable shape, size, and/or type to accommodate such insertion and motion. For example, the post connector does not have to keep the same basic post diameter at all positions along it axially.

Figure 40:
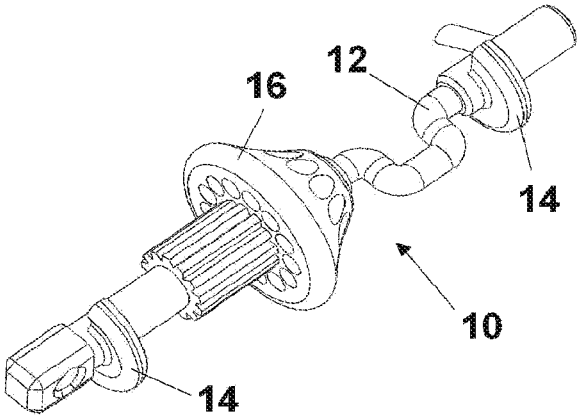
FIG. 40 illustrates another embodiment wherein the post connector is not rod shaped and shapes other than 360 degree disks or cylindrical connector guide insert into component parts.

FIG. 40 is but one example, of innumerable possible configurations, for the post connector 10 (and also 100, 103, 310, and 410, by implication), which vary from those shown in earlier figures. The post connector 10 of FIG. 40 has variable shape and size of its cross section, is not straight all along the axial direction, has cutout insertable element 14 which is part of an ellipse rather than a circular disk, and employs a connector guide 16 which is not cylindrical or quasi-cylindrical. Cutouts in any component part would match those of the particular embodiment of post connector employed.

Thus, the cutout insertable element shall be considered represented by the number 14 in all figures, even though such figures may show a disk shape. When the cutout insertable element is disk-like in shape, or an arc section of a full disk, we shall refer to it as a "disk". When such disk extends over a full 360°, we may sometimes refer to it as a "complete disk", or "360° disk". The cutout insertable element may be considerably thicker than the disk 14 shown in the figures, and may even be longer in the axial direction than its own diameter (or width in direction perpendicular to the axial.) Oval, or other shaped, cutout insertable elements (as well as connector guides) can be used, and such use may allow them to function as a cam shaft when component parts are rotated about the post axis (or about the varying radius of the oval or other shape.)

Also, cutouts on any part of a post connector, including for example a disk, may be mated with associated male portions of a component part to allow latching/connection of a post connector to a component part.

Additionally, disks 14 may have certain geometries such that by inserting them into a cutout and turning them, they lock into place.

Figure 41:
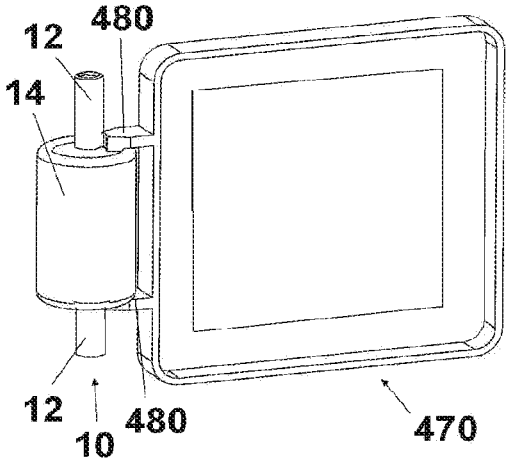
FIG. 41 displays another embodiment of the invention wherein protrusions, instead of cutouts, are used for connections.

Yet another embodiment of the invention is illustrated in FIG. 41. In this embodiment, protrusions (or protuberances) 480 on component part 470 are used for the same function as cutouts are used in other embodiments, such as that of FIG. 2. That is, the cutout insertable element(s) 14 (or, in this case, the "protrusion attachable element(s)") can be placed adjacent one or more protrusion(s) 480 on the component part, as in FIG. 41, and thus connect the post connector 10 with the component part 470.

The protrusion attachable element 14 is shown as cylindrical in shape in FIG. 41, but t can be quasi-cylindrical or any other shape. There can be one or more of them.

The component part 470 as shown in FIG. 41 has protrusions 480 on only one edge, but such protrusions, like cutouts, can be on any number of edges. In many embodiments, either protrusions like 480, or cutouts, are on every edge of a component part.

In yet another embodiment, the protrusions may be on the post connector with appropriate protrusion attachable element(s) on the component part.

In yet another embodiment, one or more protrusions (protuberances) can be on a faceplate (facemount). A post connector or any other item can then be connected directly to a faceplate.

Figure 42:
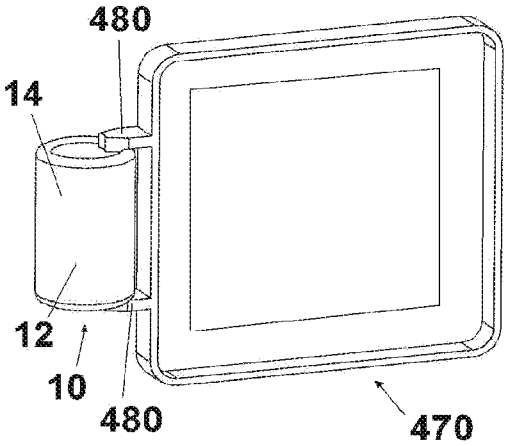
FIG. 42 shows a post connector for which the post and the component part connecting element are one and the same.

The terms "component", "component part", and "part" as used herein all have the same meaning and refer to a component part with cutout(s) as in FIG. 2, cutout insertable element(s) as in FIGS. 36 & 37, protrusion attachable elements, protrusions (or protuberances), as in FIGS. 41 & 42, used to connect such component part to a post connector, and/or any other means to connect the component part to a post connector. The generic term encompassing the aforementioned four of these element types, as well as any other means to provide, connection to a post connector, is "post connector connecting element". The invention comprises use of any of these post connector connecting element types in place of any other post connector connecting element in any configuration and/or embodiment discussed, or implied, anywhere herein, or which could be readily deduced from a discussion herein.

Similarly, the term "post connector" refers to a device with cutout insertable elements (such as in FIGS. 1 & 38, for example), protrusion attachable elements (FIGS. 41 and 42), cutouts (as in FIGS. 36 & 37, for example), protrusions (not illustrated) that can be used to connect such post connector with a component part, and/or any other means to connect the post connector to a component part. The generic term encompassing the aforementioned four of these element types, as well as any other means to provide connection to a component part, is "component part connecting element". The invention comprises use of any of these component part connecting element types in place of any other component part connecting element in any configuration and/or embodiment discussed, or implied, anywhere herein, or which could be readily deduced from a discussion herein.

The extensions of the post 12 beyond the end(s) of the protrusion attachable element 14, as shown in FIG. 41, is optional, and the invention comprises a post connector 10 without one or both of those extensions. For example, the post connector 10 can appear to be simply a cylinder such as element 14 in FIG. 42, with the post 12 considered internal to it, integral with it, or the same thing as it (as labeled in FIG. 42).

In any embodiment, a component part connecting element (such as the protrusion attachable element of FIGS. 41 and 42) may be cylindrical, quasi-cylindrical, disk shaped, partially cylindrical, partially quasi-cylindrical, partially disk shaped, or any other suitable shape. Regardless of the shape of the component part connecting element, it may be internal to, integral with, or the same thing as, the post. When we refer herein to a post and any component part connecting element, such reference comprises embodiments in which the post and the component part connecting element are one and the same thing, as well as those in which they are different.

The invention thus comprises configurations such as, and/or similar to, the post connector 10 configuration of FIG. 42 for cutout insertable elements in lieu of protrusion attachable elements, as both are component part connecting elements. It also comprises use of such configurations as post connector connecting elements (i.e., as protrusion attachable elements and/or cutout insertable elements) in component parts. As but one example of this, the cylindrical protrusion attachable element 14 of FIG. 42 can be a part of a square (or any other type of) component part, rather than a part of a post connector.

Figure 43:
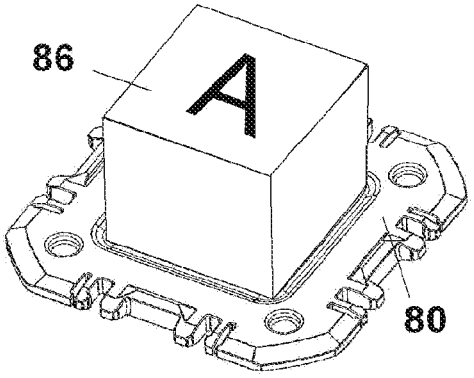
FIG. 43 depicts a faceplate (or facemount) mounted on a component part where the faceplate/mount extends well beyond the plane of the component part surface.

FIG. 43 shows another embodiment of the invention with a faceplate 86 (or facemount) extending in a third dimension considerably beyond the plane of the surface of the square part 80. In FIG. 43 the faceplate is shown as a child's letter block with the letter "A" inscribed on the outer most face. Any letter or number can be on a faceplate and thus, the invention may be used to help children learn their ABC's and numbers. Other shapes, symbols, animals, or characters can be on a faceplate, as well.

Faceplates (facemounts) can extend to any reasonable length in the third dimension out of the component part surface, and can be of any shape. They can also extend outside the edges of a component part within the 2D surface of the component part.

In another embodiment of the invention, wiring or printed circuitry could be an integral (or attached) part of components, post connectors, and/or connector guides. When these are used to construct an assembly, the wiring or printed circuitry could be used to illuminate LEDs or other lights, run motors or fans, power speakers, and/or more. Snapping, or otherwise connecting of components and post connectors together, can complete the circuits and thereby enable immediate functionality of devices such as LEDs, motors, fans, speakers, and/or more.

The preferred embodiment comprises a quasi-cylindrical connector guide 16. The term "connector guide" as used herein, however, shall refer to any shape serving the function of the connector guide 16 of FIG. 1. The quasi-cylindrical and cylindrical connector guides are special cases of the connector guide. The connector guide can be a useful part of the invention, but is not necessary for it. Embodiments may, or may not, incorporate connector guide(s).

If the connector functions as a hinge, then the connector guide may be called a hinge guide. The term connector guide refers to either a hinge connection or a non-hinge connection.

Although the cutout insertable element (360° disk 14 in FIG. 1) and the connector guide (quasi-cylindrical connector guide 16 in FIG. 1) are effectively co-axial with the main axis of the post connector 10, they do not have to be effectively coaxial with the post connector nor with each other.

The invention comprises a post connector with a post and a component part connecting element, attached to or integral with the post, with or without a connector guide. It also comprises a post connector with a post and a connector guide, attached to or integral with the post. It also comprises a single component part connecting element and a post. The component part connecting element can be placed anywhere along the post, axially or otherwise. Likewise, the connector guide can be placed anywhere along the post, axially or otherwise. The component part connecting element could also have a shape similar to that shown for the connector guide 16 in many figures herein, or any other suitable shape that serves the same function as demonstrated herein.

The invention comprises a post connector to component part connection that permits swiveling, like a hinge, of the component part relative to the post connector in the angular direction about the post connector long axis. Likewise, it comprises a post connector to component part connection that locks, i.e., resists swiveling like a hinge, of the component part relative to the post connector in the angular direction about the post connector long axis.

The invention further comprises a component comprised of a geometric shape and a post connector connecting element.

The post connector and each component part, and any of their subparts, can be made of any suitable material, including, but not limited to, plastic, metal, wood, ceramic, and rubber. They can be any size or shape, and in fact, different sizes of component parts may be assembled together in the same structure. Cutouts and protrusions (protuberances) can be any suitable size or shape.

The invention comprises essentially two dimensional (2D) component parts (thin in the third dimension), which may be assembled via post connectors into two (thin in the third dimension) and/or three dimensional (3D) structures. It also comprises component parts of three dimensions (not thin in a third dimension), which may be assembled via post connectors into 3D structures.

Although the figures show much detail, such details are not essential to the invention. The drawings merely show special cases, or embodiments, of the invention. The essential elements of the invention are recited in the claims.

Although the title of this patent application employs the word "toy", and said word is used throughout this specification, the invention is not limited to toys, but is applicable to any and all structural, and/or other, uses.

This invention can thus be seen to have significant, novel advantages over the prior art delineated in the above "Description of Prior Art" section.

While the above description contains many specificities, the reader should not construe these as limitations on the scope of the invention, but merely as exemplifications of preferred embodiments thereof. Those skilled in the art will envision many other possibilities that are within its scope.

Accordingly, the scope of the invention should be determined not by the embodiments described, but by the appended claims and their legal equivalents.

The invention claimed is:

1. A structural assembly device comprising a) a component part having predetermined shape and a post connector connecting element, wherein said component part is substantially planar in shape and b) a post connector comprised of a post and a component part connecting element wherein said component part connecting element is structurally connected to said post, wherein at least part of said component part connecting element is substantially displaced radially from a central axis of the post and extends continuously about the central axis of the post, wherein said at least part of said component part connecting element is connectable directly with said post connector connecting element, such that when connected, said at least part of said component part connecting element contacts said post connector connecting element, and wherein a plurality of said component parts may be mechanically connected to the component part connecting element around the post for movement in an angular direction via said component part connecting element and a plurality of said post connector connecting elements to form a structure, such that, when connected, said component parts can slide along the component part connecting element to swing independently relative to the post about said central axis of the post, allowing rotation of the component part about the post.

2. The device of claim 1 wherein the component part connecting element comprises a protrusion attachable element.

3. The device of claim 1 wherein the component part connecting element comprises at least a portion of a disk.

4. The device of claim 1 wherein the component part connecting element comprises at least a portion of a cylinder.

5. The device of claim 1 wherein the component part connecting element comprises at least a portion of a cylinder, wherein an end of said post and an end of said component part connecting element are effectively co-planar, and wherein said post and said component part connecting element are effectively integral.

6. The device of claim 1 wherein a cross section of the component part connecting element comprises, at least partially, an oval, or other noncircular, shaped edge.

7. The device of claim 1 wherein the component part connecting element is at least a portion of a disk, comprised, at least in part, of a cutout insertable element that can connect with the post connector connecting element.

8. The device of claim 1 wherein the post connector connecting element comprises a cutout on said component part.

9. The device of claim 1 wherein the post connector connecting element comprises a protrusion on said component part.

10. The device of claim 1 further comprising a means to provide connection stabilization attached to, or integral with, said post connector.

11. The device of claim 1 wherein said post connector further comprises a connector guide, wherein said connector guide has cylindrical or quasi-cylindrical shape and is configured to provide connection stabilization.

12. The device of claim 1 further comprising a) a connector guide configured to provide stabilization, wherein said connector guide is attached to, or integral with, the post, and b) a second post connector attached to said connector guide wherein the axes of said two post connectors are not co-axial.

13. The device of claim 1 wherein said post connector is comprised of two of said component part connecting elements.

14. The device of claim 1 wherein said at least part of said component part connecting element extends over a substantial continuous region, wherein said region effectively comprises an arc section of a circumference around the central axis of the post.

15. The device of claim 1 further comprising a facemount of predetermined shape and size wherein said facemount is attached to, or attachable to, said component part.

16. The device of claim 1 further comprising a facemount of predetermined shape and size wherein said facemount is attached to, or attachable to, said component part and wherein the shape of said facemount is substantially three-dimensional.

17. The device of claim 1 further comprising a facemount of predetermined shape and size wherein said facemount is attached to, or attachable to, said component part and wherein said facemount contains an element selected from the group consisting of decals, letters, numbers, toy figures, mirrors, wheels, axles, knobs, plugs, threaded plugs, posts, protuberances, blocks, post connectors, artificial flowers, real flowers, rods, lollipops, flags, fish, candy, glitter, lava lamp goo, holes, paintings, laser markings, pictures, tattoos, hand written sheets, printed written sheets, stencils, images, drum membranes, and other facemounts.

18. The device of claim 1 further comprising a facemount of predetermined shape and size wherein said facemount is attached to, or attachable to, said component part and to a second component part.

19. The device of claim 1 wherein an element selected from the group consisting of spheres, hooks, screw eyes, suction cups, threaded rods, magnets, whistles, springs, hinges, toys, toy figures, lollipops, wheel axles, wheels, artificial flowers, real flowers, flashlights, LEDs, and bubble wands is attached to, attachable to, or an integral part of, said post connector, wherein no element in said group is a component part connecting element.

20. The device of claim 1 further comprising an attachment to said component part wherein said attachment is selected from the group consisting of decals, letters, numbers, toy figures, mirrors, axles, wheels, knobs, plugs, threaded plugs, posts, protuberances, blocks, rods, lollipops, flags, fish, candy, glitter, lava lamp goo, paintings, laser markings, pictures, tattoos, hand written sheets, printed written sheets, stencils, images, LEDs, flashlights, bubble wands, toy figures, artificial flowers, real flowers, spheres, hooks, screw eyes, suction cups, magnets, whistles, springs, hinges, toys, and drum membranes.

21. The device of claim 1 further comprising a second component part wherein the second component part is attached inside, or attachable inside, the first component part.

22. The device of claim 1 further comprising an extended post connector comprised of four component part connecting elements arranged to permit attachment of two component parts to said extended post connector along the axial direction of said extended post connector.

23. The device of claim 1 further comprising a second post connector wherein said two post connectors are flexibly or rigidly connected at their ends, or can be flexibly or rigidly connected at their ends, to share a common axis.

24. The device of claim 1 further comprising a plurality of post connectors wherein said post connectors are, or can be, flexibly or rigidly connected to one another, and wherein the axes of said post connectors, when connected, do not share a common axis.

25. The device of claim 1, wherein said component part connecting element comprises at least a portion of a disk and wherein said at least a portion of a disk and said post are integral.

26. The device of claim 1 further comprising a second component part and an angle limiting component wherein said angle limiting component restricts angular motion of said first component part relative to second component part.

27. The device of claim 1 wherein string, cord, wire or similar element can be passed through the inside of at least one post connector.

28. The device of claim 1 wherein at least one of said post connector and said component part comprises a musical instrument.

29. The device of claim 1 wherein said component part connecting element is comprised, at least in part, of a portion of a disk, and said post connector connecting element is attachable to said portion of a disk via contact with both a top and bottom sides of said portion of a disk.

30. The device of claim 1 further comprising a) a plurality of post connectors b) a plurality of component parts, and c) pieces of reflective material wherein said pieces of reflective material are mounted, or can be readily mounted, on at least some of the plurality of component parts, the plurality of post connectors, or facemounts attached to component parts, and wherein said pieces of reflected material are arranged to redirect sunlight to effectively a common focal region.

31. The device of claim 1 further comprising electronic circuitry wherein said electronic circuitry powers LEDs, other lights, motors, fans, speakers or other electrical devices wherein said electrical devices are connected, or can be connected, to component parts, post connectors, a facemount, or connector guides.

32. The device of claim 1 further comprising:

a) a plurality of post connectors wherein each said post connector is comprised of a connector guide and two disk shaped component part connecting elements, and b) a plurality of component parts, each said component part comprised of connector guide cutouts, post connector connecting elements comprised of cutouts, latch elements, and relief cutouts.

33. The device of claim 1 further comprising:

a) a plurality of post connectors wherein each said post connector is comprised of two disk shaped component part connecting elements, and b) a plurality of component parts, each comprised of a post connector connecting element, wherein each disk shaped component part connecting element may be snapped together with at least one post connector connecting element.

34. The device of claim 1 wherein a wheel axle or at least one wheel is attached to, attachable to, or an integral part of, said post connector or said component part.

35. A method for structural toy assembly comprising a) making a component part having predetermined shape and having a post connector connecting element, wherein said component part is substantially planar in shape;

b) constructing a post connector comprised of a post and a component part connecting element wherein said component part connecting element is structurally connected to said post, wherein the step of constructing the post connector comprises making the post connector such that at least part of said component part connecting element is substantially displaced radially from a central axis of the post and extends continuously about the central axis of the post, wherein the step of constructing the post connector comprises making the post connector such that said at least part of said component part connecting element is connectable directly with said post connector connecting element, such that when connected, said at least part of said component part connecting element contacts said post connector connecting element, and wherein the step of making a component part comprises making the component part such that a plurality of said component parts may be mechanically connected to the component part connecting element around the post for movement in an angular direction via said component part connecting element and a plurality of said post connector connecting elements to form a structure, such that, when connected, said component parts can slide along the component part connecting element to swing relative to the post about said central axis of the post, allowing rotation of the component part about the post.

36. The method for structural toy assembly of claim 35 further comprised of a) constructing a plurality of post connectors wherein each said post connector has a connector guide and two component part connecting elements comprised of disks, and b) making a plurality of component parts, each having connector guide cutouts, post connector connecting elements comprised of cutouts, latch elements, and relief cutouts, wherein at least some of said component parts have shapes selected from the group consisting of triangles, squares, rectangles, diamonds, pentagons, hexagons, octagons, rectangular solids, cylinders, sections of cylinders, and tetrahedrons.

37. The method for structural toy assembly of claim 35 further comprising making a facemount, the facemount attachable to said component part wherein said facemount contains an element selected from the group consisting of decals, letters, numbers, toy figures, mirrors, wheels, axles, knobs, plugs, threaded plugs, posts, protuberances, blocks, post connectors, artificial flowers, real flowerers, rods, lollipops, flags, fishes, candy, glitter, lava lamp goo, holes, paintings, laser markings, pictures, tattoos, hand written sheets, printed written sheets, stencils, images, drum membranes, and other facemounts.

* * * * *